US011020927B2

(12) United States Patent
Kohno et al.

(10) Patent No.: US 11,020,927 B2
(45) Date of Patent: Jun. 1, 2021

(54) DOUBLE BLANK DETECTING DEVICE FOR PRESS MACHINE AND DIE PROTECTING DEVICE FOR PRESS MACHINE

(71) Applicant: AIDA ENGINEERING, LTD., Kanagawa (JP)

(72) Inventors: Yasuyuki Kohno, Kanagawa (JP); Shuichi Matsuno, Kanagawa (JP)

(73) Assignee: AIDA ENGINEERING, LTD., Kanagawa (JP)

( * ) Notice: Subject to any disclaimer, the term of this patent is extended or adjusted under 35 U.S.C. 154(b) by 303 days.

(21) Appl. No.: 16/000,794

(22) Filed: Jun. 5, 2018

(65) Prior Publication Data

US 2018/0354219 A1 Dec. 13, 2018

(30) Foreign Application Priority Data

Jun. 7, 2017 (JP) ..... JP2017-112440

(51) Int. Cl.
*B30B 15/30* (2006.01)
*B30B 15/00* (2006.01)
(Continued)

(52) U.S. Cl.
CPC ..... *B30B 15/282* (2013.01); *B21D 24/02* (2013.01); *B21D 43/025* (2013.01); *B21D 55/00* (2013.01);
(Continued)

(58) Field of Classification Search
CPC ..... B30B 15/16; B30B 15/281; B30B 15/282; B30B 15/028; B30B 15/026;
(Continued)

(56) References Cited

U.S. PATENT DOCUMENTS 4,442,591 A 4/1984 Grow et al.
2006/0090533 A1 5/2006 Fujibayashi et al.
(Continued)

FOREIGN PATENT DOCUMENTS

CN 1765538 A 5/2006
DE 1296089 B 5/1969
(Continued)

OTHER PUBLICATIONS

Extended European Search Report issued in corresponding European Patent Application No. 18176049.7, dated Nov. 6, 2018.
(Continued)

*Primary Examiner* — Jimmy T Nguyen
(74) *Attorney, Agent, or Firm* — McDermott Will & Emery LLP

(57) ABSTRACT

The double blank detecting device for a press machine uses a press machine with a die cushion device attached thereto, and automatically and repeatedly forms blank materials one by one. The double blank detecting device includes: a position signal acquiring unit that acquires a die cushion position signal indicating a position of a cushion pad of the die cushion device; a load signal acquiring unit that acquires a die cushion load signal indicating a die cushion load generated in the cushion pad of the die cushion device; and a double blank detecting unit that detects, as a double blank, a state where a plurality of the blank materials are overlapped, based on the die cushion position signal and the die cushion load signal that are acquired.

14 Claims, 15 Drawing Sheets

(51) Int. Cl.

| | |
|---|---|
| ***B30B 15/02*** | (2006.01) |
| ***B21D 24/02*** | (2006.01) |
| ***B21D 43/02*** | (2006.01) |
| ***B30B 15/28*** | (2006.01) |
| ***B21D 55/00*** | (2006.01) |

(52) U.S. Cl.
CPC ..... *B30B 15/0094* (2013.01); *B30B 15/026* (2013.01); *B30B 15/028* (2013.01)

(58) Field of Classification Search
CPC .... B30B 15/0094; B21D 24/02; B21D 24/08; B21D 24/14; B21D 43/025; B21D 55/00
See application file for complete search history.

(56) References Cited

U.S. PATENT DOCUMENTS

| | | | | |
|---|---|---|---|---|
| 2014/0202223 | A1* | 7/2014 | Kohno | B21D 24/14 72/20.1 |
| 2016/0184876 | A1* | 6/2016 | Kondo | B30B 15/007 72/20.1 |
| 2016/0354828 | A1* | 12/2016 | Kohno | B21D 24/10 |

FOREIGN PATENT DOCUMENTS

| | | | |
|---|---|---|---|
| FR | 3008010 | A1 | 1/2015 |
| GB | 964314 | A | 7/1964 |
| IT | 1137278 | B | 9/1986 |
| JP | S57-176200 | U | 11/1981 |
| JP | S57-156300 | U | 10/1982 |
| JP | S62-134124 | A | 6/1987 |
| JP | H10-193199 | A | 7/1998 |
| JP | 2008-200756 | A | 9/2008 |
| JP | 2010-042442 | A | 2/2010 |
| JP | 4610635 | B2 | 10/2010 |

OTHER PUBLICATIONS

Translation of Notification of Reasons for Refusal issued in corresponding Japanese Patent Application No. 2017-112440, dated Jun. 13, 2019.

Chinese Office Action issued in corresponding Chinese Patent Application No. 201810577459.6, dated Mar. 3, 2021, with English translation.

* cited by examiner

DOUBLE BLANK DETECTING DEVICE FOR PRESS MACHINE AND DIE PROTECTING DEVICE FOR PRESS MACHINE

CROSS-REFERENCE TO RELATED APPLICATIONS

The present application claims priority under 35 U.S.C. § 119 to Japanese Patent Application No. 2017-112440, filed on Jun. 7, 2017. The above application is hereby expressly incorporated by reference, in its entirety, into the present application.

BACKGROUND OF THE INVENTION

Field of the Invention

The present invention relates to a double blank detecting device for a press machine, and a die protecting device for a press machine, and more particularly to a technology of reliably detecting a double blank (two blank materials) in a case where the double blank is supplied to a press machine.

Description of the Related Art

Conventionally, as a method for detecting such a double blank, there is a method described in Japanese Patent Application Laid-Open No. 10-193199 (PTL 1).

In a case where a blank material (workpiece) is formed by using a linear motion type press machine of a system for driving an oil hydraulic cylinder for vertically moving a slide by a servo valve, when a slide position is detected at a time of rapid rising of a press load signal (calculated from a pressure signal for lowering and a pressure signal for rising of the oil hydraulic cylinder) at a forming start time point, and the detected slide position is outside a plate thickness allowable range (plate thickness allowable range set according to a reference plate thickness position for a single workpiece), a die protecting device of a linear motion type press described in PTL 1 determines that a double blank is generated, and moves the slide in a direction opposite to a direction at the time of pressurizing work. A die cushion device is not attached to the linear motion type press described in PTL 1.

As a widely and generally used double blank detection system, there is a system in which a double blank detecting mechanism is provided in a die (upper die) such that a limit switch is turned on only at a time of double blank generation.

CITATION LIST

Patent Literature

PTL 1: Japanese Patent Application Laid-Open No. 10-193199

SUMMARY OF THE INVENTION

In the method for detecting a double blank described in PTL 1, a press load and a slide position are detected. And, when a slide position is detected at a time of a rapid rising of the press load at a forming start time point, and the detected slide position is outside a plate thickness allowable range, then it is determined that the double blank is generated. However, the change range (variation) of the detected slide position is large, the slide position exceeds the plate thickness of a single blank material to be changed, and therefore there is a problem that the double blank cannot be accurately detected.

It is considered that this reason is because the press machine is heavy, thick, long and large relative to the die cushion device attached thereto, resolution in detection of a press load, or slide position detection is low, or the press load is generated in accordance with a forming load or state change (such as linear expansion of a column) of a press machine secondarily (without control).

In a case where the double blank detecting mechanism is provided in the die such that the limit switch is turned on only at the time of double blank generation, there are a plurality of problems described below.

Firstly, it is time-consuming to perform fine adjustment for each die. Much time is required for the fine adjustment for each die since the limit switch is not tuned on when the blank number is normal, namely one, but the limit switch is tuned on when the blank number is two.

Secondly, detection accuracy is low. At the forming start time point at which a double blank is detected (to be detected), a machine is often brought into an excessive state accompanied by vibration. Thus, it is difficult that the limit switch having a mechanical detecting mechanism accurately (stably) performs detection of about 1 mm.

The present invention has been made in view of such circumstances, and an object of the present invention is to provide a double blank detecting device for a press machine, and a die protecting device for a press machine capable of reliably detecting a double blank in a case where the double blank is supplied to a press machine.

In order to achieve the above object, the present invention according to an aspect is a double blank detecting device for a press machine that uses a press machine with a die cushion device attached thereto, and automatically and repeatedly forms blank materials one by one, the double blank detecting device having: a position signal acquiring unit that acquires a die cushion position signal indicating a position of a cushion pad of the die cushion device; a load signal acquiring unit that acquires a die cushion load signal indicating a die cushion load generated in the cushion pad of the die cushion device; and a double blank detecting unit that detects, as a double blank, a state where a plurality of the blank materials are overlapped, based on the die cushion position signal acquired by the position signal acquiring unit, and the die cushion load signal acquired by the load signal acquiring unit.

According to the aspect of the present invention, in place of detection of the slide position and the press load described in PTL 1, the position of the cushion pad and the die cushion load are detected, and the double blank is detected based on the die cushion position signal indicating the position of the cushion pad and the die cushion load signal indicating the die cushion load.

In a press cycle of the press machine that automatically and repeatedly forms the blank materials one by one, in a case where the thicknesses of the blank materials are constant (normal), the cushion pad position signal and the die cushion load signal have higher responsiveness and higher accuracy, and more stable than a slide position signal and a press load signal.

For example, in a case where a thin plate (blank material) having a plate thickness of about 1 mm is formed, it is important that stability of the cushion pad position signal and the die cushion load signal at a normal time, namely, a change range is small, in order to reliably detect an abnormality (double blank) of changing the thickness to about 2 mm.

In the press cycle of the press machine, the double blank is detected by using the cushion pad position signal and the die cushion load signal which are more stable than the slide position signal and the press load signal, and therefore it is possible to reliably detect the double blank.

In a double blank detecting device for a press machine according to another aspect of the present invention, it is preferable that the double blank detecting unit hold a die cushion position signal at a time point when the die cushion load signal rises to a predetermined value, compare the holding value of the held die cushion position signal with an abnormality identification value, and detect the double blank. The die cushion position signal holding value at the time point of rising to the constant die cushion load signal (predetermined value) is stable at the normal time, and therefore it is possible to reliably detect the abnormality (double blank) from the change of the die cushion position signal holding value.

In a double blank detecting device for a press machine according to yet another aspect of the present invention, it is preferable that in a case where die cushion load control by the die cushion device is started with a position of a slide of the press machine at a time of indirect collision of the slide with the single blank material as a reference, where the abnormality identification value is designated by Y, an average value of the die cushion position signal holding values obtained by repeatedly forming the single blank material a plurality of number of times is designated by $X_{AVE}$, and a plate thickness of the blank material is designated by T, the abnormality identification value Y be set to a value satisfying a condition as follows:

$$Y \leq (X_{AVE} - 0.3T), \text{ and } Y > (X_{AVE} - T), \text{ and}$$

the double blank detecting unit detect, as the double blank, a state where the holding value of the held die cushion position signal is smaller than the abnormality identification value Y.

In a case where the die cushion load control start time point is the slide position reference (time point when the slide position reaches a predetermined die cushion start slide position), when the double blank is detected, the die cushion load control start time point of the slide position reference is at a die cushion position smaller by the single blank material (pressed by the slide) than that at the normal time, and therefore the die cushion position signal holding value is smaller than the average value $X_{AVE}$. The case where the die cushion position signal holding value is smaller than the above abnormality identification value Y is detected as the double blank, so that it is possible to reliably detect the double blank (two or more blank materials).

In a double blank detecting device for a press machine according to yet another aspect of the present invention, it is preferable that in a case where die cushion control by the die cushion device is started with a position of a slide of the press machine at a time of indirect collision of the slide with the single blank material as a reference, where the abnormality identification value is designated by Y, a die cushion position signal holding value obtained in a case where double blank materials are tried is designated by X', and a plate thickness of the blank material is designated by T, the abnormality identification value Y be set to a value satisfying a condition as follows:

$$Y \geq (X' + 0.1T), \text{ and } Y \leq (X' + 0.7T), \text{ and}$$

the double blank detecting unit detect, as the double blank, a state where the holding value of the held die cushion position signal is smaller than the abnormality identification value Y.

The abnormality identification value Y is set in the range of the value obtained by adding the change amount (10 to 70% of the plate thickness T of the blank material) to the die cushion position signal holding value X', and the case where the die cushion position signal holding value is smaller than the above abnormality identification value Y is detected as the double blank, so that it is possible to reliably detect the double blank. The change amount is mainly influenced by natural vibration of a machine at the moment of indirect contact of the slide with the cushion pad to be changed, and the degree is 10 to 70% of the plate thickness T empirically.

In a double blank detecting device for a press machine according to yet another aspect of the present invention, it is preferable that in a case where die cushion load control by the die cushion device is started with die cushion load change generated in the cushion pad due to indirect collision of a slide of the press machine with the cushion pad as a reference, where the abnormality identification value is designated by Y, an average value of the die cushion position signal holding values obtained by repeatedly forming the single blank material a plurality of number of times is designated by $X_{AVE}$, and a plate thickness of the blank material is designated by T, the abnormality identification value Y be set to a value satisfying a condition as follows:

$$Y \geq (X_{AVE} + 0.3T), \text{ and } Y < (X_{AVE} + T), \text{ and}$$

the double blank detecting unit detect, as the double blank, a state where the holding value of the held die cushion position signal is larger than the abnormality identification value Y.

In a case where the die cushion load control start time point is the die cushion load generation reference (at the moment of indirect contact of the slide with the cushion pad), when the double blank is detected, contact is caused at a die cushion position larger than that at the normal time by the single blank material, and die cushion load starts rising, and therefore the die cushion position signal holding value becomes larger than the average value $X_{AVE}$. The case where the die cushion position signal holding value is larger than the above abnormality identification value Y is detected as the double blank, so that it is possible to reliably detect the double blank.

In a double blank detecting device for a press machine according to yet another aspect of the present invention, it is preferable that in a case where die cushion load control by the die cushion device is started with die cushion load change generated in the cushion pad due to indirect collision of a slide of the press machine with the cushion pad as a reference, where the abnormality identification value is designated by Y, a die cushion position signal holding value obtained in a case where double blank materials are tried is designated by X', and a plate thickness of the blank material is designated by T, the abnormality identification value Y be set to a value satisfying a condition as follows:

$$Y \leq (X' - 0.1T), \text{ and } Y \geq (X' - 0.7T), \text{ and}$$

the double blank detecting unit detect, as the double blank, a state where the holding value of the held die cushion position signal is larger than the abnormality identification value Y.

The abnormality identification value Y is set in the range of the value obtained by subtracting the change amount (10 to 70% of the plate thickness T of the blank material) from the die cushion position signal holding value X', and the case where the die cushion position signal holding value is larger than the above abnormality identification value Y is detected as the double blank, so that it is possible to reliably detect the double blank.

A double blank detecting device for a press machine according to yet another aspect of the present invention preferably further includes a first manual setter that manually sets the abnormality identification value, or a first automatic setter that automatically calculates and sets the abnormality identification value.

In a double blank detecting device for a press machine according to yet another aspect of the present invention, it is preferable that a predetermined value of the die cushion load signal be a value within a range of not less than 5% and not more than 20% of a maximum die cushion load of the die cushion device.

A double blank detecting device for a press machine according to yet another aspect of the present invention preferably further includes a second manual setter that manually sets a predetermined value of the die cushion load signal, or a second automatic setter that automatically calculates and sets the predetermined value of the die cushion load signal based on the maximum die cushion load of the die cushion device.

In a double blank detecting device for a press machine according to yet another aspect of the present invention, it is preferable that the die cushion device include a die cushion position detector that detects the position of the cushion pad, and outputs the die cushion position signal, and a die cushion load detector that detects the die cushion load generated in the cushion pad, and outputs the die cushion load signal, the position signal acquiring unit acquire the die cushion position signal from the die cushion position detector, and the load signal acquiring unit acquire the die cushion load signal from the die cushion load detector.

The cushion pad position signal and the die cushion load signal can be acquired from the die cushion device, and addition of a detector dedicated for detection of these signals is unnecessary, and therefore an inexpensive device can be obtained.

A die protecting device for a press machine according to yet another aspect of the present invention having: the press machine has a braking device that brakes a slide driven by a press driving device of the press machine, and a hydraulic cylinder that is incorporated in the slide, and moves a die mounting surface of the slide relative to movement of the slide driven by the press driving device; the above double blank detecting device for a press machine; and a safety processing device that causes the braking device to start quick braking of the slide, and depressurizes the hydraulic cylinder to relatively move one portion including the die mounting surface of the slide in an elevating direction, when the double blank detecting unit detects the double blank.

When the double blank detecting unit detects the double blank, the braking device starts quick braking of the slide. In a case of a servo motor driven press machine, maximum torque is caused to act on the servo motor in the braking direction, and applies quick braking. Even when the quick braking is started, stopping of the slide requires limited time by inertia of the slide or the like, forming advances during the limited time, and the risk of breaking the die increases. Therefore, the quick braking is started, and the hydraulic cylinder incorporated in the slide is immediately depressurized, so that the one portion including the die mounting surface of the slide is relatively movable in the elevating direction. Consequently, the slide (die) is safely stopped before forming is started, and the breakage of the die is prevented (die is protected).

In a die protecting device for a press machine according to yet another aspect of the present invention, it is preferable that the die cushion device include: a die cushion driving unit that supports the cushion pad, elevates and lowers the cushion pad, and generates a die cushion load in the cushion pad; a die cushion load command device that outputs a die cushion load command; and a die cushion load controller that controls the die cushion driving unit based on the die cushion load command output from the die cushion load command device, and generates a die cushion load corresponding to the die cushion load command in the cushion pad, wherein the die cushion load command device outputs a predetermined die cushion load command, causes the hydraulic cylinder to contract by a die cushion load generated in the cushion pad in response to the die cushion load command, and to relatively move one portion including a die mounting surface of the slide in an elevating direction, in a period when the slide reaches a stop, only in a region where forming is not started among a region where the cushion pad moves, when the double blank detecting unit detects the double blank.

Contraction action of the hydraulic cylinder is facilitated by the die cushion load added from the cushion pad, and the hydraulic cylinder incorporated in the slide is contracted, and the one portion including the die mounting surface of the slide relatively moves in the elevating direction with the contraction of the hydraulic cylinder. The predetermined die cushion load command is output in a period when the slide reaches a stop, only in the region where forming is not started. On the contrary, in the forming region at the time of double blank detection being the state extremely dangerous for the die, the die cushion load basically is not caused to act. In the forming region, in other case, for example, in a case where a light beam type safety device is shielded, at the time of press machine emergency stop with operation, a cope is different from a cope in a situation where the predetermined die cushion load acts in order to suppress damage of the die due to generation of drawing wrinkle until the slide is stopped.

In a die protecting device for a press machine according to yet another aspect of the present invention, it is preferable that the die cushion device include: a die cushion position command device that outputs a die cushion position command; and a die cushion position controller that controls the die cushion driving unit based on the die cushion position command output from the die cushion position command device after termination of die cushion load control by the die cushion load controller, and raises the cushion pad to move the cushion pad to a predetermined die cushion standby position, wherein the predetermined die cushion standby position is a position obtained by movement in the elevating direction from a forming start position by a predetermined amount. This is because a stop period of the slide until the forming is started (lowering amount of the die mounting surface of the slide) is secured, in a case where the double blank is detected.

In a die protecting device for a press machine according to yet another aspect of the present invention, the region where the forming is not started is a region between the predetermined die cushion standby position, and a position at which the forming is started.

In a die protecting device for a press machine according to yet another aspect of the present invention, it is preferable that when the double blank detecting unit detects the double blank, the die cushion load command device automatically output a maximum die cushion load command as the predetermined die cushion load command.

When the double blank is detected, the maximum die cushion load is caused to act on the slide with the hydraulic cylinder incorporated therein, and the hydraulic cylinder is contracted as fast as possible, so that formed is not started.

According to the double blank detecting device for a press machine according to the present invention, the position of the cushion pad, and the die cushion load having high detection accuracy are used for the detection of the double blank, and therefore in a case where the double blank is supplied to the press machine, it is possible to reliably detect this.

According to the die protecting device for a press machine according to the present invention, when the above double blank detecting device detects the double blank, quick braking of the slide is started by the braking device, the hydraulic cylinder incorporated in the slide is depressurized, and the one portion including the die mounting surface of the slide is relatively moved in the elevating direction, and therefore the slide (die) can be safely stopped before forming is started, and it is possible to prevent breakage of the die (protection of the die).

DETAILED DESCRIPTION OF THE EMBODIMENTS

Hereinafter, embodiments of a double blank detecting device for a press machine, and a die protecting device for a press machine according to the present invention is described with reference to the attached drawings.

Figure 1:
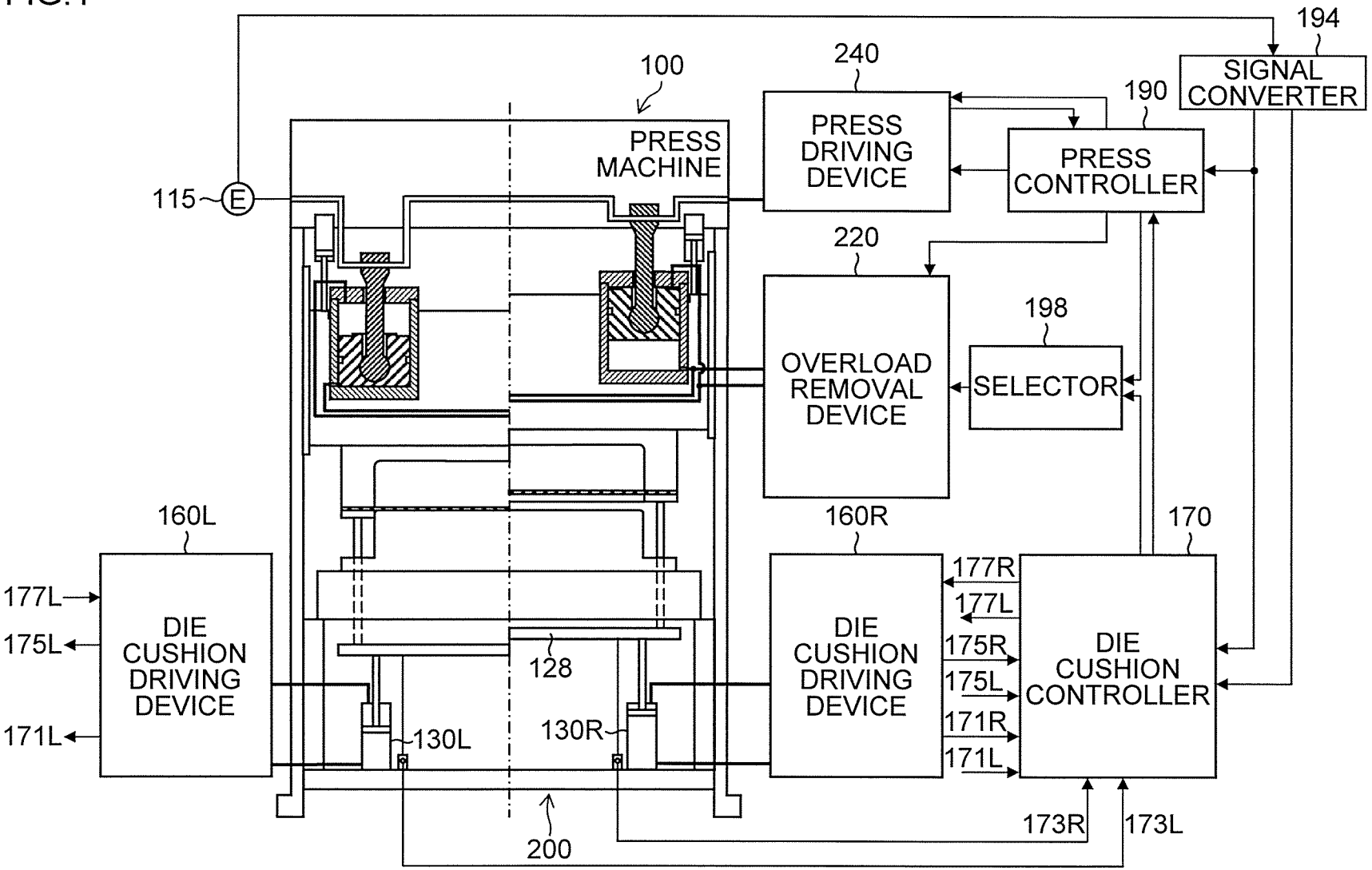
FIG. 1 is a schematic configuration diagram illustrating an embodiment of an entire device including a press machine, a die cushion device, and a die protecting device.

FIG. 1 is a schematic configuration diagram illustrating an embodiment of an entire device including a press machine, a die cushion device, and a die protecting device.

As illustrated in FIG. 1, this entire device includes a press machine 100, and a die cushion device 200, and the press machine 100 includes a press controller 190, an overload removal device 220, and a press driving device 240.

The die cushion device 200 includes a cushion pad 128, oil hydraulic cylinders 130R, 130L, die cushion driving devices 160R, 160L, a die cushion controller 170, and the like.

In this example, a die protecting device 300 (FIG. 6) for a press machine according to the present invention is constituted in the die cushion controller 170, a double blank detecting device 302 is constituted in the die protecting device 300.

[Mechanism Portion of Press Machine]

Figure 2:
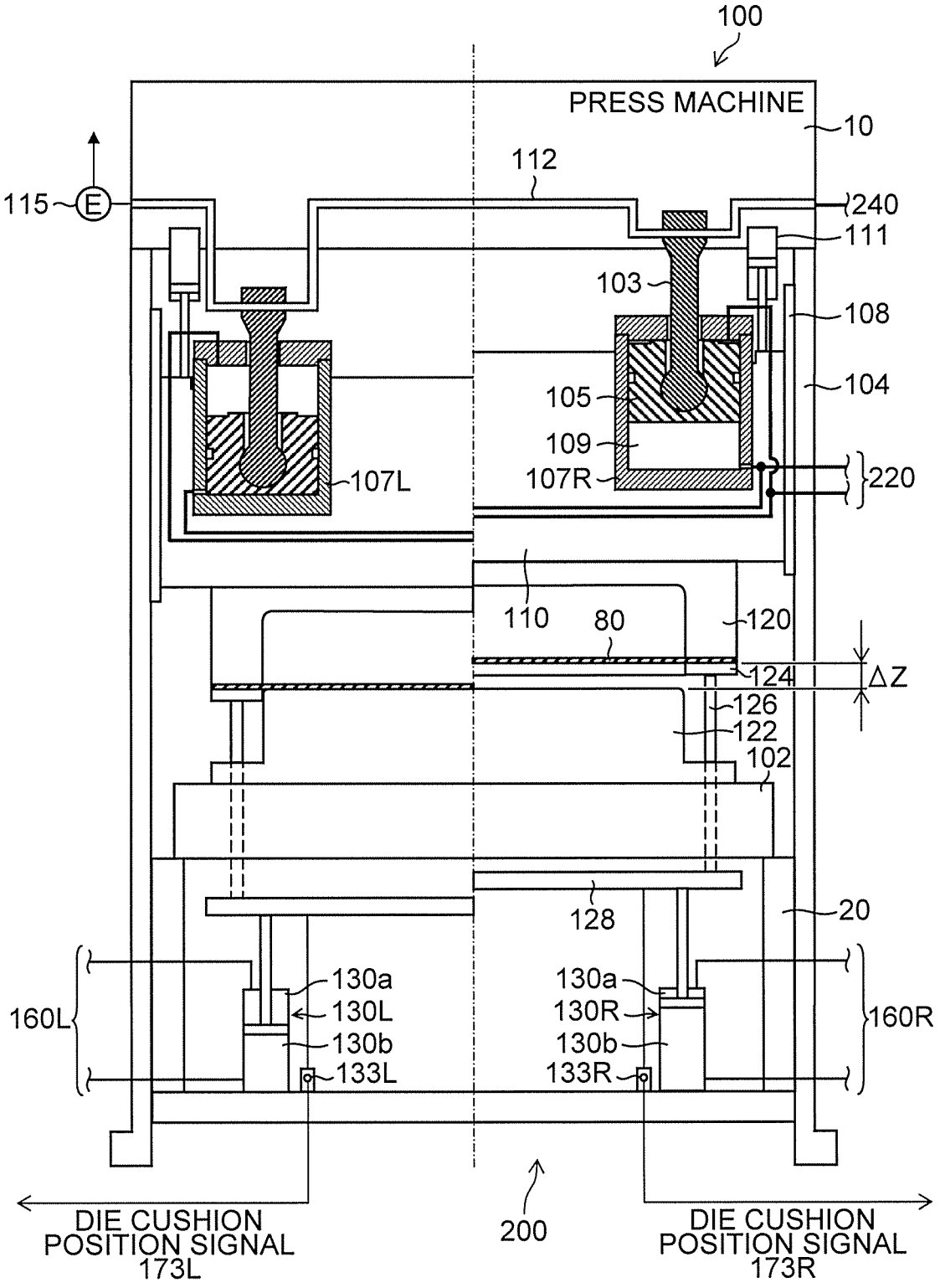
FIG. 2 is a diagram illustrating a mechanism portion of a press machine 100 and a die cushion device 200 illustrated in FIG. 1.

FIG. 2 is a diagram illustrating a mechanism portion of the press machine 100 and the die cushion device 200 illustrated in FIG. 1.

In the press machine 100 illustrated in FIG. 1, a flame is composed of a crown 10, a bed 20, and a plurality of columns 104 disposed between the crown 10 and the bed 20, and a slide 110 is movably guided in the vertical direction by sliding members 108 provided in the columns 104.

This press machine 100 is a so-called mechanical servo press in which the slide 110 is driven by a servo motor described below through a crank shaft 112, and connecting rods 103, and performs drawing of a large thin plate such as a body forming of a vehicle in this example.

Rotational driving force from the press driving device 240 is transmitted to the crank shaft 112, and an encoder 115 for detecting the angle and the angular velocity of the crank shaft 112 is provided.

A pair of left and right oil hydraulic cylinders (hydraulic cylinders) 107L, 107R are incorporated in (fixed to) the slide 110, and leading ends of the connecting rods 103 are rotatably fixed to pistons 105 of the oil hydraulic cylinders 107L, 107R.

FIG. 2 illustrates the oil hydraulic cylinder 107R illustrated on the right, the oil hydraulic cylinder 107R being in a state where the piston 105 moves to an upper end, and illustrates the oil hydraulic cylinder 107L illustrated on the left, the oil hydraulic cylinder 107L being in a state where the piston moves to a lower end.

These oil hydraulic cylinders 107L, 107R expand and contract, so that relative positions between leading end positions of the connecting rods 103 and a die mounting surface (lower surface) of the slide 110 are changed. That is, the oil hydraulic cylinders 107L, 107R can relatively move the die mounting surface of the slide 110 by extension and contraction of the oil hydraulic cylinders 107L, 107R with respect to movement of the slide 110 driven by the crank shaft 112 and the connecting rods 103.

A pair of balancer cylinders 111 that apply upward force to the slide 110 are disposed between the slide 110 and the crown 10.

An upper die 120 is mounted on the die mounting surface of the slide 110, and a lower die 122 is mounted on an upper surface of a bolster 102 on the bed 20.

[Mechanism Portion of Die Cushion Device]

The die cushion device 200 presses a peripheral edge of material (blank material) formed by the press machine 100 from a lower side, and mainly includes a blank holder (wrinkle pressing plate) 124, the cushion pad 128, and a pair of left and right oil hydraulic cylinders 130L, 130R.

The cushion pad 128 supports blank holders 124 through a plurality of cushion pins 126.

The oil hydraulic cylinders 130L, 130R function as die cushion driving units for supporting the cushion pad 128, elevating and lowering the cushion pad 128, and generating a die cushion load to the cushion pad 128.

Die cushion position detectors 133L, 133R that detect positions in the extending and contracting direction of the piston rods as positions in the elevating and lowering direction of the cushion pad 128 (die cushion positions) are provided near the oil hydraulic cylinders 130L, 130R, respectively.

The material (blank material) 80 is set on (brought into contact with) upper sides of the blank holders 124 by a carrier device (not illustrated).

When the upper die 120 mounted on the die mounting surface of the slide 110 collides with the cushion pad 128 through the blank material 80, the blank holders 124, and the cushion pins 126 with lowering operation of the slide 110, thereafter the blank material 80 is formed between the upper die 120 and the lower die 122 while the peripheral edge of the blank material 80 is pressurized and held between the blank holders 124 to which die cushion loads are applied from the oil hydraulic cylinders 130L, 130R, and the upper die 120.

The maximum die cushion load of the die cushion device 200 of this example is 3000 kN, the die cushion load set value is 2000 kN, and the die cushion stroke is 200 mm. However, in a die cushion stroke of 200 mm, 15 mm is a non-forming stroke ΔZ (ΔZ=15 mm) from when the upper die 120 comes into contact with the blank material 80 until when the blank material 80 comes into contact with the lower die 122. That is, standby positions of the blank holders 124 are each set to a position (Z2) larger than a forming start position (position Z1 at which the blank material 80 comes into contact with the lower die 122), and forming is not started during the stroke ΔZ (=Z2−Z1) before forming start at which the position of the slide lower surface is larger than Z1. In this example, the plate thickness of the blank material 80 is 1 mm.

[Press Driving Device]

Figure 3:
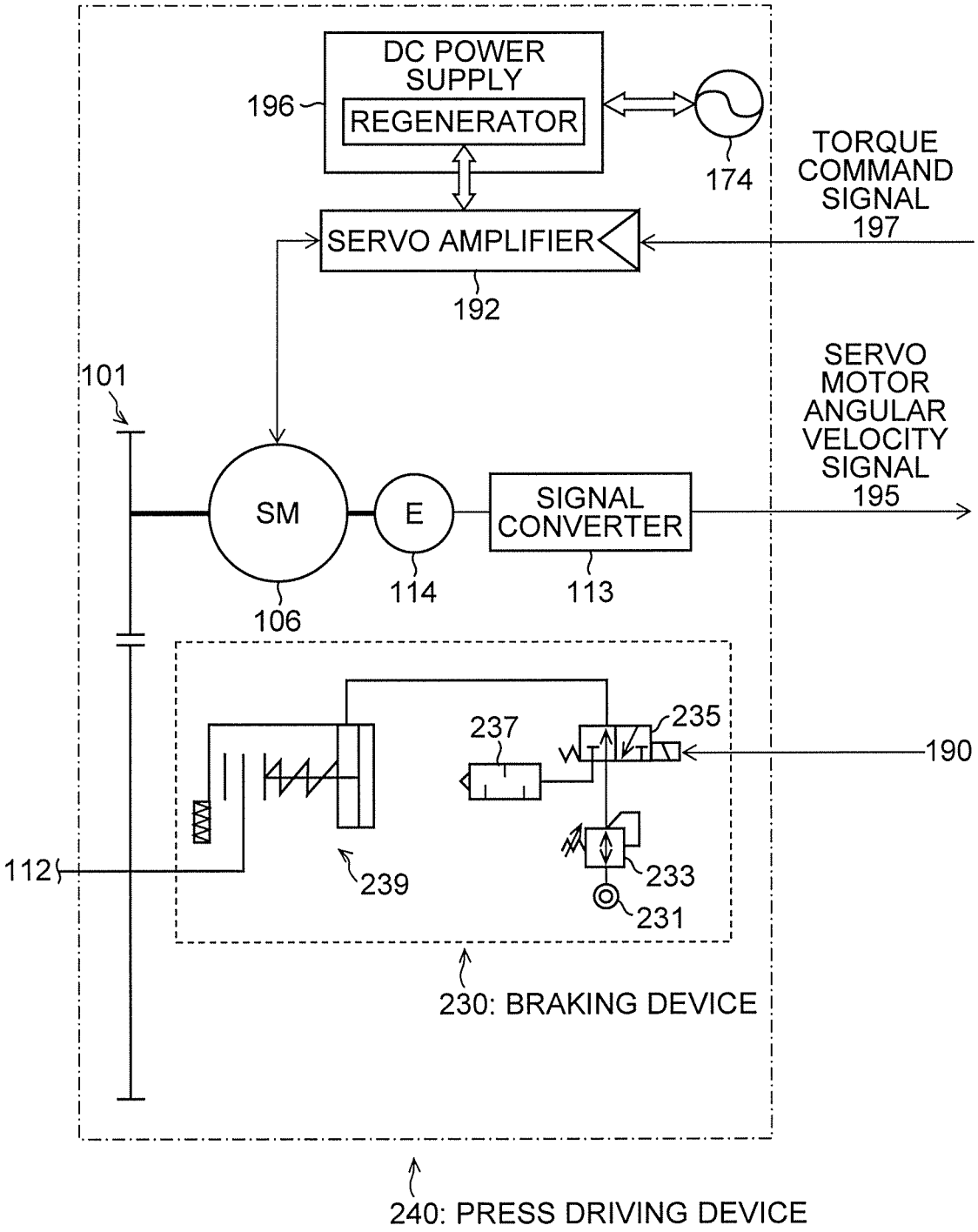
FIG. 3 is a configuration diagram illustrating an example of a press driving device 240 illustrated in FIG. 1.

FIG. 3 is a configuration diagram illustrating an example of the press driving device 240 illustrated in FIG. 1.

The press driving device 240 functions as a driving device and a braking device of the press machine 100 (slide 110), and includes a servo motor 106, a reduction gear 101 that transmits rotational driving force of the servo motor 106 to the crank shaft 112, and a braking device 230.

A driving electric power corresponding to a torque command signal 197 is supplied from a servo amplifier 192 to the servo motor 106, and the servo motor 106 is driven and controlled such that the speed becomes a predetermined (set) sliding speed or crank shaft angular velocity. Power is supplied from a DC (Direct Current) power supply 196 with a regenerator to the servo amplifier 192, and electric power generated by a driving torque of the servo motor 106 acting in the braking direction at the time of braking of the press machine 100 (slide 110) is regenerated to an AC power supply 174 through the servo amplifier 192 and the DC power supply 196.

An encoder 114 is mounted on a rotating shaft of the servo motor 106, an encoder signal output from the encoder 114 is converted to a servo motor angular velocity signal 195 by a signal converter 113.

The braking device 230 has a solenoid valve 235 for brake release to which compressed air is supplied from an air pressure source 231 through a reducing valve 233, a brake mechanism 239, and a silencer 237.

A driving signal is added from the press controller 190 to the solenoid valve 235 for brake release, and ON/OFF control of the solenoid valve 235 for brake release is performed.

At a normal time (operation with no abnormality), the solenoid valve 235 for brake release of the braking device 230 is turned on, a brake is released, and when (various) abnormality occurs, a torque command signal 197 of the direction opposite to the slide operation direction is given to the servo amplifier 192, so that the slide 110 is braked, and after stopping (at almost the same time as stopping), the solenoid valve 235 for brake release is turned off, and the brake is caused to act.

[Overload Removal Device]

Figure 4:
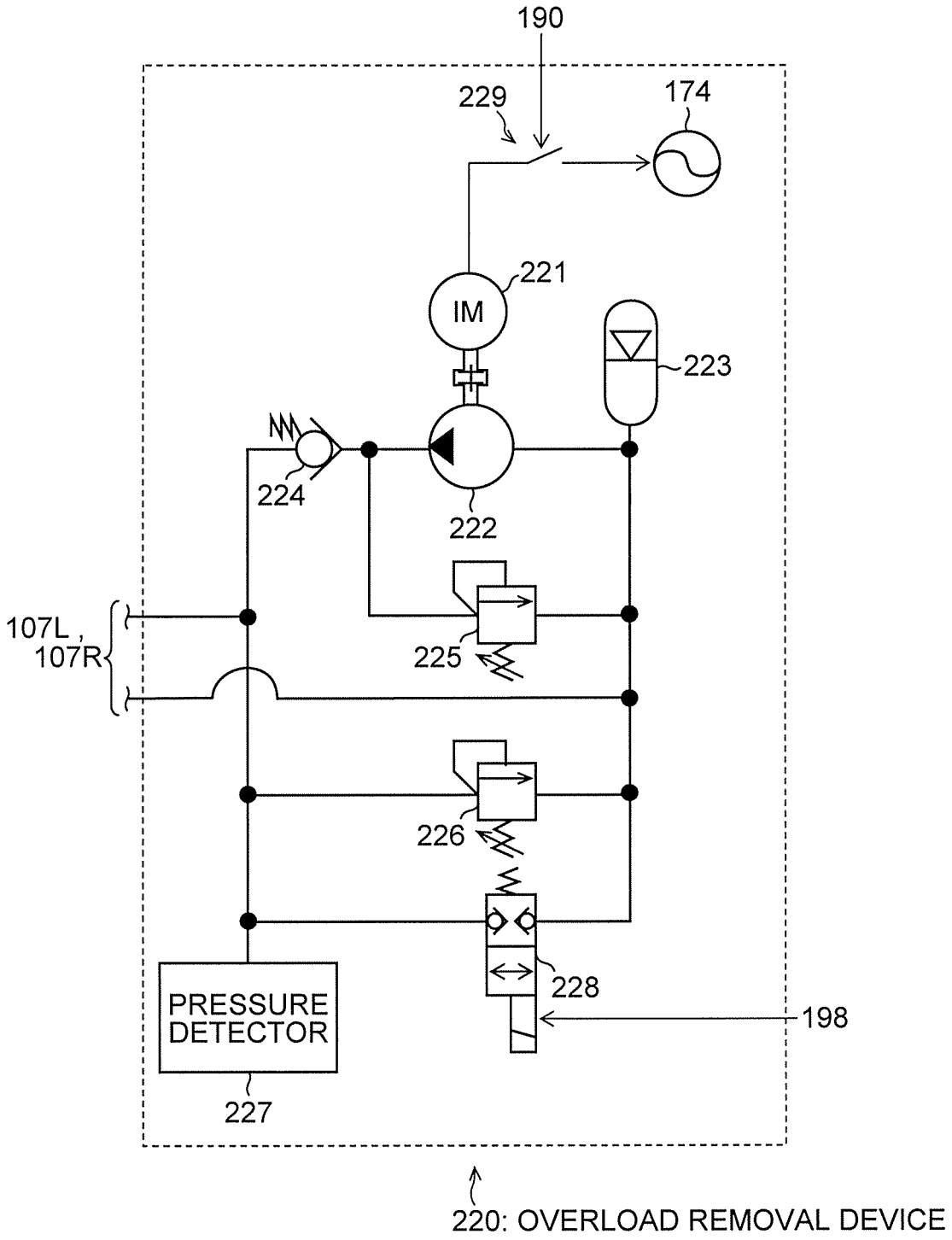
FIG. 4 is a configuration diagram illustrating an example of an overload removal device 220 illustrated in FIG. 1.

FIG. 4 is a configuration diagram illustrating an example of the overload removal device 220 illustrated in FIG. 1.

As illustrated in FIG. 4, the overload removal device 220 includes an oil hydraulic pump 222 axially connected to an induction motor 221, an accumulator 223, a check valve 224 disposed on a discharge port side of the oil hydraulic pump 222, relief valves 225, 226, a pressure detector 227, and a solenoid (depressurizing) valve 228.

A high pressure line where the pressure detector 227 is disposed is connected to head-side hydraulic chambers 109 of the oil hydraulic cylinders 107R, 107L incorporated in the slide 110, and a low pressure line connected to the accumulator 223 is connected to rod-side hydraulic chambers of the oil hydraulic cylinders 107R, 107L (FIG. 2).

At a normal time, pressure of initial pressure P0 (about 200 kg/cm$^2$) acts on the head-side hydraulic chambers 109, and the oil hydraulic cylinders 107R, 107L are most extended in a no-load state (state in which load does not act on the slide 110 from outside) (state on the right in FIG. 2).

In a case where the head-side hydraulic chambers 109 are pressurized, in a state where the slide 110 is at a top dead center (at least no-load state), a contactor 229 is turned on (is turned off after P0 is confirmed) until the initial pressure P0 is confirmed by the pressure detector 227.

The setting pressure of the relief valve 225 that acts on the discharge port of the oil hydraulic pump 222 is set slightly larger than the initial pressure P0, and therefore it is possible to control the almost constant initial pressure P0 regardless of OFF delay time of the contactor 229.

The head-side hydraulic chambers 109 are connected to the accumulator 223 composing the low pressure line equivalent to a tank function, through the relief valve 226 and the solenoid valve 228, and in a case where abnormal cylinder pressure PU (about 320 kg/cm$^2$) equivalent to pressure when an abnormal load acts on the slide 110 (for example, 22,000 kN equivalent to 110% of maximum permissible load 20,000 kN of the press machine 100 in this example) acts, the relief valve 226 operates, the pressure detector 227 detects the operation of the relief valve, the solenoid valve 228 is turned on, and the head-side hydraulic chambers 109 is depressurized.

In this example, the cylinder stroke of each of the oil hydraulic cylinders 107R, 107L is 30 mm.

[Die Cushion Driving Device]

Figure 5:
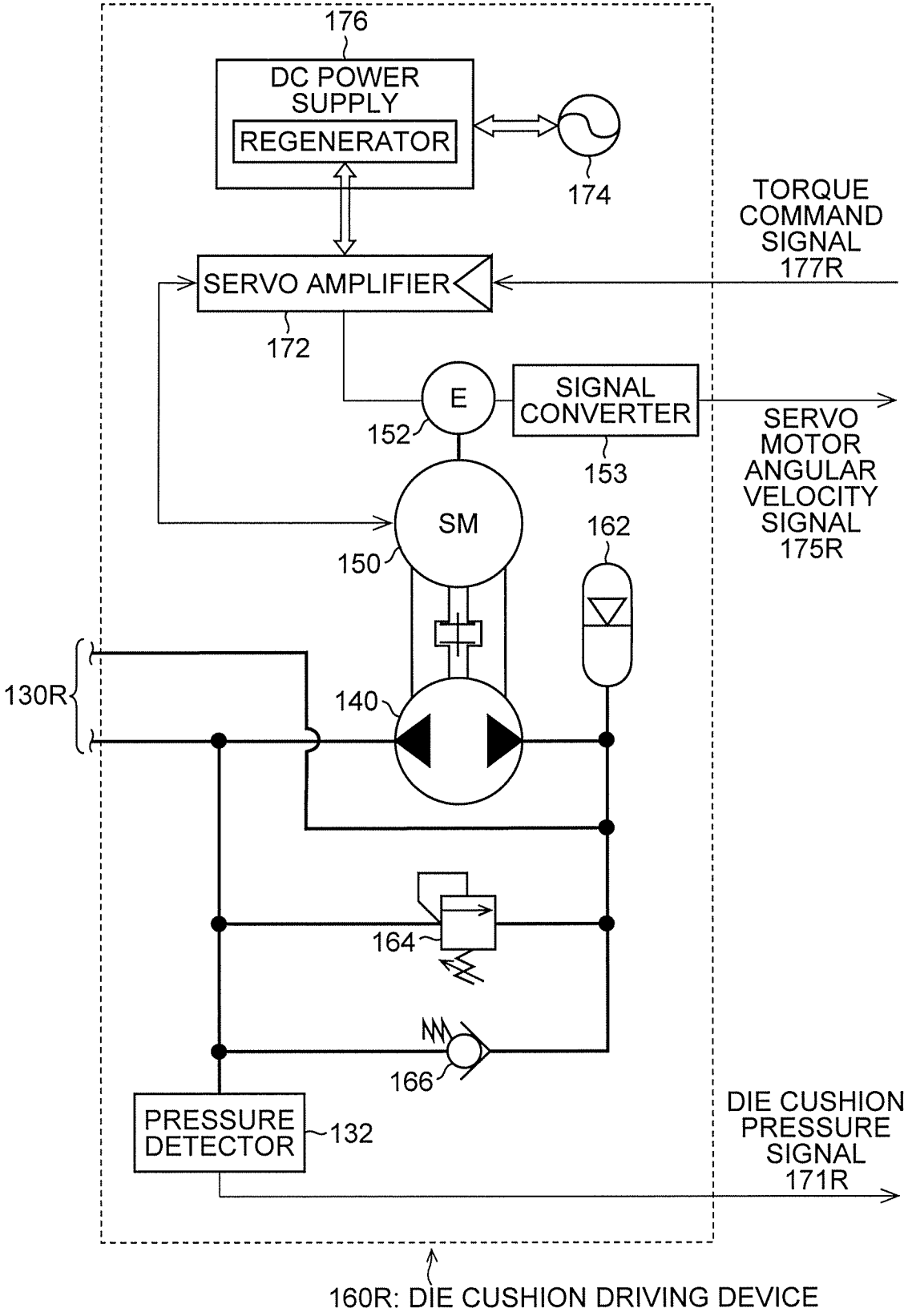
FIG. 5 is a configuration diagram illustrating an example of a die cushion driving device 160R illustrated in FIG. 1.

FIG. 5 is a configuration diagram illustrating an example of the die cushion driving device 160R illustrated in FIG. 1.

The die cushion driving device 160R includes an oil hydraulic circuit that supplies hydraulic oil to the rod-side hydraulic chamber 130*a*, and the head-side hydraulic chamber 130*b* of the oil hydraulic cylinder 130R illustrated in FIG. 2, and includes an accumulator 162, an oil hydraulic pump/motor 140, a servo motor 150 connected to a drive shaft of the oil hydraulic pump/motor 140, an encoder 152 for detecting the angular velocity (servo motor angular velocity ω) of a drive shaft of the servo motor 150, a relief valve 164, a check valve 166, and a pressure detector 132 equivalent to a die cushion load detector.

A die cushion driving device 160L that supplies hydraulic oil to the oil hydraulic cylinder 130L has the same configuration as the die cushion driving device 160R, and therefore the die cushion driving device 160R is hereinafter described.

The accumulator 162 is set to low gas pressure and plays a role as a tank, and also plays a role to supply substantially constant low pressure oil to the head-side hydraulic chamber 130*b* (cushion pressure generation side pressurizing chamber) of the oil hydraulic cylinder 130R through the check valve 166, and to be likely to increase pressure at the time of die cushion load control.

One (discharge port) of ports of the oil hydraulic pump/motor 140 is connected to the head-side hydraulic chamber 130*b* of the oil hydraulic cylinder 130R, and the other port is connected to the accumulator 162.

The relief valve 164 is provided as a device which operates at the time of abnormal pressure generation (when a die cushion load cannot be controlled, and sudden abnormal pressure is generated), and prevents breakage of hydraulic equipment. The rod-side hydraulic chamber 130*a* of the oil hydraulic cylinder 130R is connected to the accumulator 162.

The pressure detector 132 detects the pressure that acts on the head-side hydraulic chamber 130*b* of the oil hydraulic cylinder 130R, a die cushion pressure signal 171R that indicates the detected pressure is output, an encoder signal that is output from the encoder 152 mounted on the drive shaft of the servo motor 150 is converted to a servo motor angular velocity signal 175R by a signal converter 153.

The die cushion driving device 160R outputs a torque command signal 177R input from the die cushion controller 170 described below to the servo motor 150 through a servo amplifier 172, and drives the oil hydraulic pump/motor 140.

Consequently, the oil hydraulic cylinder 130R is driven, and die cushion pressure (load) control and die cushion position control are performed.

[Principle of Die Cushion Load Control]

The die cushion load (force) may be represented by a product of the pressure of the head-side hydraulic chamber of the oil hydraulic cylinder that supports the cushion pad, and a cylinder area. Thus, control of the die cushion load means control of the pressure of the head-side hydraulic chamber of the oil hydraulic cylinder.

Where oil hydraulic cylinder/die cushion pressure generation side cross-sectional area: a;

oil hydraulic cylinder/die cushion pressure generation side volume: V;

die cushion pressure: P;

electric (servo) motor torque: T;

moment of inertia of servo motor: I;

viscous resistance coefficient of servo motor: DM;

friction torque of servo motor: fM;

displacement volume of oil hydraulic motor: Q;

force that applies to oil hydraulic cylinder piston rod from slide: $F_{slide}$;

pad speed generated by pressing by press: v;

inertial mass of oil hydraulic cylinder piston rod+pad: M;

viscous resistance coefficient of oil hydraulic cylinder: DS;

frictional force of oil hydraulic cylinder: fS;

servo motor angular velocity rotated by pressing by pressure oil: ω;

volume elastic modulus of hydraulic oil: K; and factor (constant) of proportionality: k1, k2, static behavior can be expressed by Expressions (1) and (2).

$$P=\int K((v\cdot A-k1\,Q\cdot\omega)/V)dt \quad (1)$$

$$T=k2\cdot PQ/(2\pi) \quad (2)$$

Additionally, dynamic behavior can be expressed by Expression (3) and (4) in addition to Expressions (1) and (2).

$$PA-F=M\cdot dv/dt+DS\cdot v+fS \quad (3)$$

$$T-k2\cdot PQ/(2\pi)=I\cdot d\omega/dt+DM\cdot\omega+fM \quad (4)$$

What the above Expressions (1) to (4) means, namely, force transmitted from the slide 110 to the oil hydraulic cylinders 130L, 130R through the cushion pad 128 compresses the head-side hydraulic chambers 130*b* of the oil hydraulic cylinders 130L, 130R to generate die cushion pressure. At the same time, the oil hydraulic pump/motor 140 is caused to perform oil hydraulic motor action by die cushion pressure, and when rotating shaft torque generated in this oil hydraulic pump/motor 140 becomes against driving torque of the servo motor 150, the servo motor 150 is rotated, and rise of the pressure is suppressed. At last, the die cushion pressure (die cushion load) is determined in accordance with the driving torque of the servo motor 150.

The die cushion pressure signal 171R output from the pressure detector 132, and the servo motor angular velocity signal 175R output from the signal converter 153 are used to generate the torque command signal 177R in the die cushion controller 170.

The torque command signal 177R is output to the servo motor 150 through the servo amplifier 172, the driving torque of the servo motor 150 is controlled, and pressure applied to the head-side hydraulic chamber 130*b* of the oil hydraulic cylinder 130R from the oil hydraulic pump/motor 140 having the drive shaft connected to the servo motor 150 is controlled, so that a die cushion load generated from the oil hydraulic cylinder 130R is controlled.

Power from a DC power supply 176 with a regenerator is supplied to the servo amplifier 172, and electric power generated by the servo motor 150 driven by driving force from the oil hydraulic pump/motor 140 that acts as an oil hydraulic motor is regenerated in the AC (Alternating Current) power supply 174 through the servo amplifier 172 and the DC power supply 176, during die cushion load (pressure) control.

[Press Controller and Die Cushion Controller]

Figure 6:
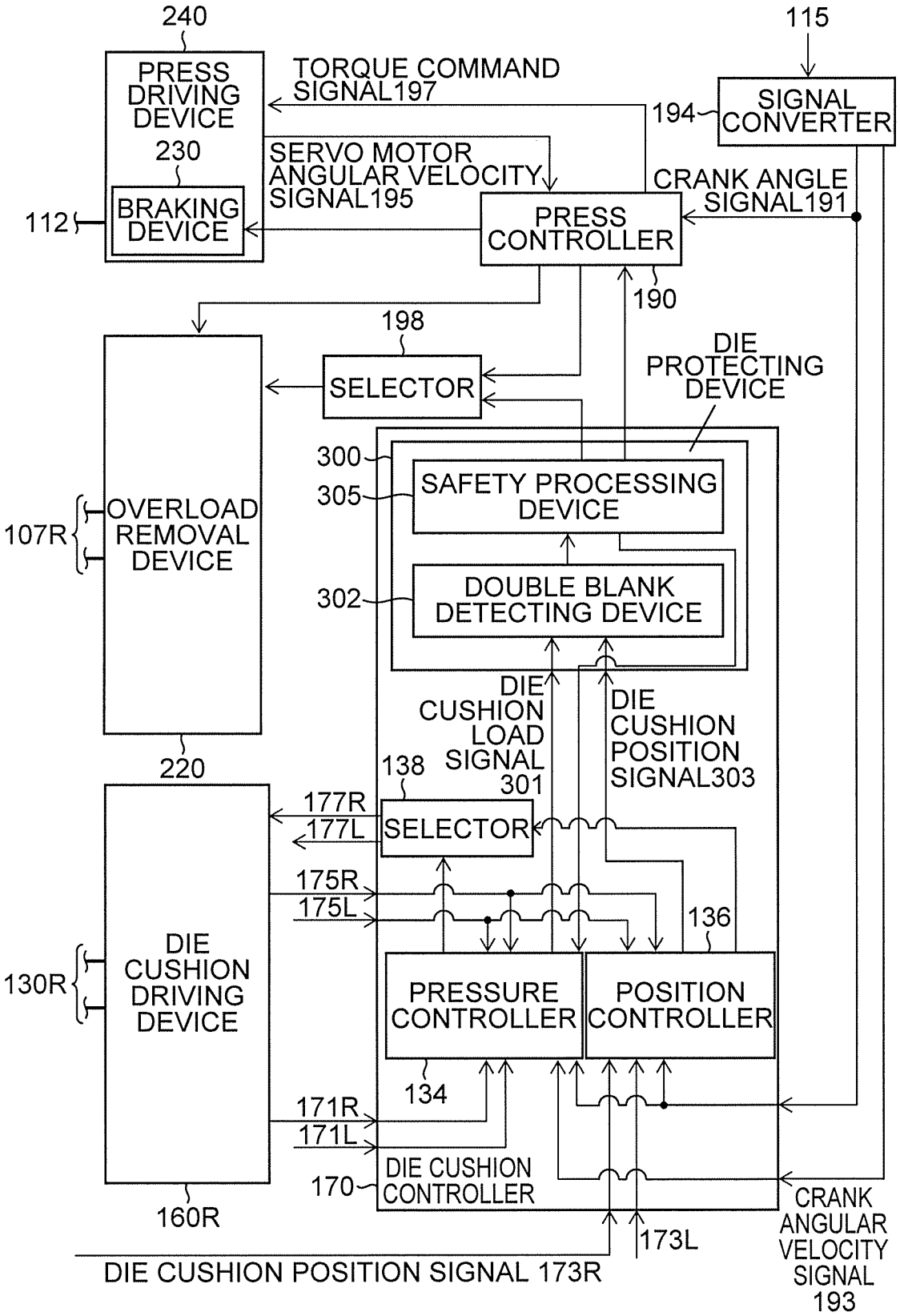
FIG. 6 is a configuration diagram mainly illustrating an embodiment of a die cushion controller 170 illustrated in FIG. 1.

FIG. 6 is a configuration diagram mainly illustrating an embodiment of the die cushion controller 170 illustrated in FIG. 1.

The die cushion controller 170 illustrated in FIG. 6 includes the die protecting device 300 according to the present invention, in addition to a pressure controller (die cushion load controller) 134 and a position controller 136.

To the pressure controller 134, the die cushion pressure signals 171R, 171L, the servo motor angular velocity signals 175R, 175L, a crank angle signal 191, a crank angular velocity signal 193, and a switching command (switching command for causing a die cushion load at maximum capacity to act at the time of double blank detection) of a die cushion load from a safety processing device 305 described below are added. The crank angle signal 191 and the crank angular velocity signal 193 are signals that indicate the angle and the angular velocity of the crank shaft 112, and are converted by a signal converter 194 that inputs an encoder signal output from the encoder 115 mounted on the crank shaft 112.

The pressure controller 134 includes a die cushion pressure command device (die cushion load command device) that outputs a preset die cushion pressure (load) command, and inputs the die cushion pressure signals 171R, 171L in order to control die cushion pressure based on the die cushion pressure command.

The pressure controller 134 mainly inputs the servo motor angular velocity signals 175R, 175L as angular velocity feedback signals for securing dynamic stability in die cushion pressure (load) control and position control, and further inputs the crank angular velocity signal 193 indicating the crank angular velocity in order to use for compensation for securing pressure control accuracy in the die cushion pressure (load) control.

Furthermore, the pressure controller 134 inputs the (changeable) crank angle signal 191 corresponding to a position of the slide 110 in order to obtain start timing of a die cushion function, starts or ends the die cushion pressure (load) control based on the input crank angle signal 191 (slide position), and the die cushion pressure (load) command device in the pressure controller 134 outputs a corresponding die cushion pressure (load) command based on the crank angle signal 191.

During the die cushion pressure (load) control, the pressure controller 134 outputs the torque command signals 177R, 177L calculated by using the input die cushion pressure command, die cushion pressure signals 171R, 171L, servo motor angular velocity signals 175R, 175L, and crank angular velocity signal 193 to the die cushion driving devices 160R, 160L through a selector 138.

When a die cushion load switching command for automatically switching the die cushion load from the safety processing device 305 at the time of double blank detection is input, the pressure controller 134 outputs the torque command signals 177R, 177L corresponding to maximum pressurizing capacity (command for causing a general die cushion load of 2000 kN to act in vehicle body forming use, in this example).

One the other hand, to the position controller 136, die cushion position signals 173R, 173L, the servo motor angular velocity signals 175R, 175L, and the crank angle signal 191 are added.

The position controller 136 includes a die cushion position command device. The die cushion position signals 173R, 173L are added to the die cushion position command device in order to use for initial value generation in die cushion position command generation. After the slide 110 (cushion pad 128) reaches a bottom dead center, and the die cushion pressure (load) control is terminated, the die cushion position command device performs product knockout operation, and outputs a common position command (die cushion position command) for controlling a die cushion position (position of the cushion pad 128) in order to make the cushion pad 128 wait at a die cushion standby position which is an initial position.

In the case of a die cushion position control state, the position controller 136 generates the torque command signals 177R, 177L based on the common die cushion position command output from the die cushion position command device, and the die cushion position signals 173R, 173L detected by the die cushion position detectors 133L, 133R respectively, and outputs the generated torque command signals 177R, 177L to the selector 138. It is preferable that the position controller 136 input the servo motor angular velocity signals 175R, 175L, and perform position control in the elevating and lowering direction of the cushion pad 128 based on the input servo motor angular velocity signals 175R, 175L, in order to secure dynamic stability in position control. Furthermore, it is preferable that the crank angle signal 191 be input, and position control be performed based on the input crank angle signal 191 at the time of knockout such that the cushion pad 128 does not collide with the slide 110 indirectly.

In the case of a die cushion pressure (load) control state, the selector 138 selects the torque command signals 177R, 177L input from the pressure controller 134 by a selection command input from the pressure controller 134, and outputs the input torque command signals 177R, 177L to the die cushion driving devices 160R, 160L, and in the case of a die cushion position control state, the selector 138 selects the torque command signals 177R, 177L input from the position controller 136, and outputs the input torque command signals 177R, 177L to the die cushion driving devices 160R, 160L.

The die cushion controller 170 outputs the torque command signals 177R, 177L generated as described above to the die cushion driving devices 160R, 160L, drives the servo motor 150 through the servo amplifier 172 inside the die cushion driving devices 160R, 160L, and performs die cushion pressure (load) control and die cushion position control.

The crank angle signal 191, and the servo motor angular velocity signal 195 are added to the press controller 190, the press controller 190 generates the torque command signal 197 such that the speed becomes a predetermined sliding speed or crank shaft angular velocity based on the input crank angle signal 191, and servo motor angular velocity signal 195, and outputs the generated torque command signal 197 to the press driving device 240 (servo amplifier 192). The servo motor angular velocity signal 195 is used as the angular velocity feedback signal for securing the dynamic stability of the slide 110.

The press controller 190 generates the torque command signal 197 for making maximum torque act on the press driving device 240 in the braking direction based on a braking command input from the die protecting device 300, and outputs a signal for turning on/off the braking device 230 (solenoid valve 235 for brake release).

<Die Protecting Device>

As illustrated in FIG. 6, the die cushion controller 170 of this example is constituted by including the die protecting device 300.

The die protecting device 300 may be constituted inside the die cushion controller 170, since a die cushion load signal 301 and a die cushion position signal 303 are applied. The die protecting device 300 has a mission of quickly identifying and processing an abnormality, and higher speed calculation processing time is required, and therefore, for example, the calculation cycle of a controller in a configuration in which the die protecting device 300 is constituted inside the die cushion controller 170 that takes on die cushion load (die cushion pressure) control (power control) is generally faster than the calculation cycle (requires faster calculation cycle) of a controller in a configuration in which the die protecting device 300 is constituted inside the press controller 190 that takes on angle control (position control) of the slide (crank shaft), and therefore more effective. Furthermore, waste time accompanying input/output processes of both the signals can be omitted, and therefore the die cushion controller 170 is more effective, compared to a case where the die protecting device is separately provided.

The die protecting device 300 includes the double blank detecting device 302 and the safety processing device 305.

[Double Blank Detecting Device 302]

Figure 7:
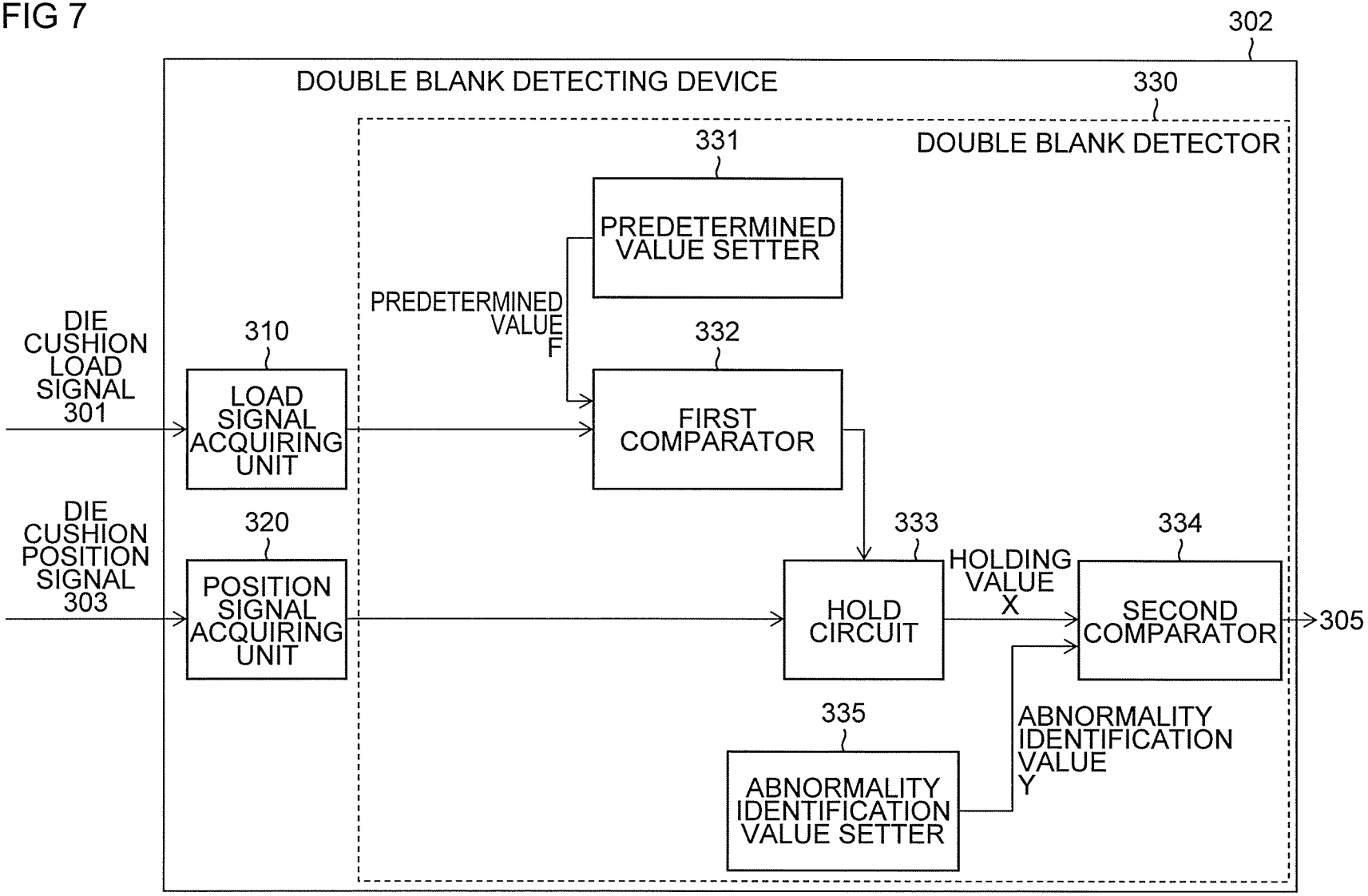
FIG. 7 is a block diagram illustrating an embodiment of a double blank detecting device 302.

FIG. 7 is a block diagram illustrating an embodiment of the double blank detecting device 302.

As illustrated in FIG. 7, the double blank detecting device 302 includes a load signal acquiring unit 310, a position signal acquiring unit 320, and a double blank detector 330, and the double blank detector 330 further includes a predetermined value setter 331, a first comparator 332, a hold circuit 333, a second comparator 334, and an abnormality identification value setter 335.

The load signal acquiring unit 310 is a component that acquires the die cushion load signal 301 indicating a die cushion load generated in the cushion pad 128 of the die cushion device 200, and inputs the die cushion load signal 301 indicating the die cushion load calculated based on the die cushion pressure signals 171R, 171L by the pressure controller 134 of the die cushion controller 170, from the pressure controller 134. The load signal acquiring unit 310 may directly input the die cushion pressure signals 171R, 171L to acquire the die cushion load signal 301 indicating the die cushion load calculated based on these die cushion pressure signals 171R, 171L.

The position signal acquiring unit 320 is a component that acquires the die cushion position signal 303 indicating the position of the cushion pad 128 of the die cushion device 200, and inputs the die cushion position signal 303 calculated as the average value of the die cushion position signals 173R, 173L by the position controller 136 of the die cushion controller 170, from the position controller 136. The position signal acquiring unit 320 may directly input the die cushion position signals 173R, 173L to acquire the die cushion position signal 303 calculated as the average value of these die cushion position signals 173R, 173L.

The die cushion load signal 301 acquired by the load signal acquiring unit 310 is output to the first comparator 332. A predetermined value F is added as other input of the first comparator 332 from the predetermined value setter 331, and the first comparator 332 compares these 2 inputs, and outputs a signal for enabling the hold circuit 333 to perform hold operation when the die cushion load signal 301 reaches the predetermined value F.

Herein, it is preferable that the predetermined value F set by the predetermined value setter 331 be in a range of not less than 5% and not more than 20% of the maximum die cushion load of the die cushion device 200. In this example, the maximum die cushion load is set to 3000 kN, and the predetermined value F is set to F=200 kN. The predetermined value F may be manually set by a manual setter (second manual setter), or may be automatically calculated and set based on the maximum die cushion load of the die cushion device by an automatic setter (second automatic setter).

The die cushion position signal 303 acquired by the position signal acquiring unit 320 is output to the hold circuit 333.

The hold circuit 333 holds the die cushion position signal 303 when the die cushion load signal 301 rises to the predetermined value (F) every cycle (when the signal is input from the first comparator 332) with the start of die cushion load action.

The die cushion position signal holding value X held by the hold circuit 333 is output to the second comparator 334. The abnormality identification value Y is added as other input of the second comparator 334 from the abnormality identification value setter 335, and the second comparator 334 detects a state where the two (plurality of) blank materials 80 are overlapped, as a double blank, based on the comparison result of these 2 inputs.

Figure 8:
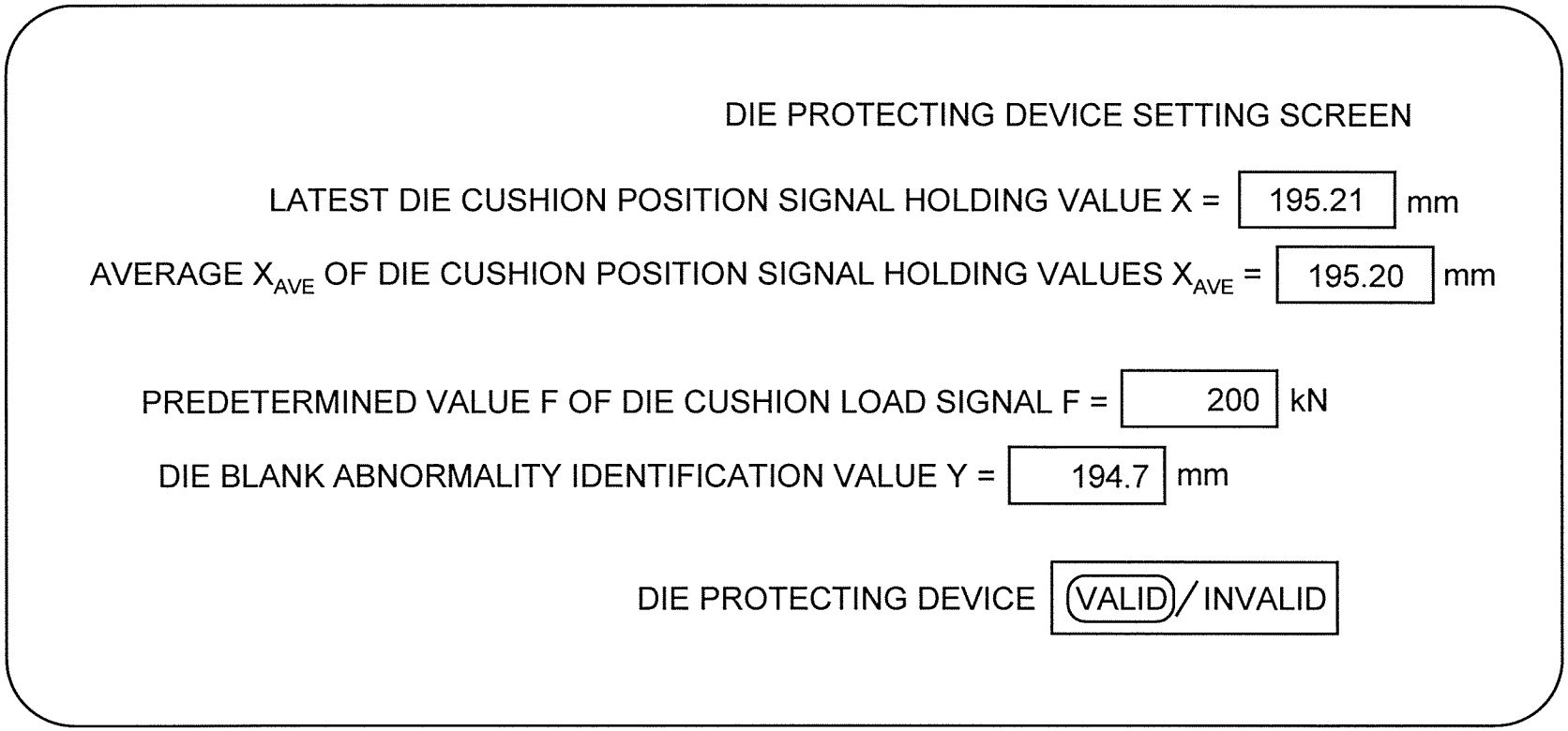
FIG. 8 is a diagram illustrating an example of a die protecting device setting screen.

FIG. 8 is a diagram illustrating an example of a die protecting device setting screen.

The double blank abnormality identification value Y for detecting a double blank in contrast to the die cushion position signal holding value X normally repeated (in a case of a single sheet is formed) a plurality of number of times is displayed as Y=194.7 mm every forming (condition inherent to forming such as a die, a material, a die cushion load set value, and the speed setting and the die height setting of a press machine) on the die protecting device setting screen in this example. This is automatically calculated in the double blank detecting device.

In this example, as described below, a die cushion load control start time point is recognized by a slide position reference (time point when the slide position reaches a predetermined die cushion start slide position), the die cushion load control start time point of the slide position reference is at a die cushion position smaller by a single blank material (pressed by the slide 110) than that at a normal time at the time of double blank detection, and therefore the die cushion position signal holding value X is smaller than an average value $X_{AVE}$.

In this example, the latest value of the die cushion position signal holding value is X=195.21 mm, and the average value of the die cushion position signal holding values is $X_{AVE}$=195.2 mm. The latest value is a value in a latest (last) cycle in production performed in the past, and is held just before a next die cushion load action start time point. The average value is the average value of a plurality of number of times (100 times in this example) in normal production (with no abnormality) performed in the past. The calculation cycle of the die cushion controller 170 is 0.25 ms, left and right die cushion loads are controlled every 0.25 ms so as to follow a target die cushion load, and die cushion position signal hold process calculation is performed, and therefore change in the die cushion position signal holding value at a normal time is small. The latest value and the average value of the die cushion position signal holding value is always displayed on the die protecting device setting screen (FIG. 8) of a die cushion operating unit.

First Embodiment of Double Blank Detection

A first embodiment of the double blank detection is applied to a case where die cushion load control according to the die cushion device 200 is started with a position of the slide 110 at the time of indirect collision of the slide 110 of the press machine 100 with the single blank material 80 as a reference, as described above.

An abnormality identification value Y of the first embodiment is a value obtained by subtracting a half of the plate thickness (1 mm) from the average value of the die cushion position signal holding values X, namely, $X_{AVE}$=195.2 mm (where the plate thickness is designated by T, $Y=X_{AVE}-0.5T=195.2-0.5\times1=194.7$).

The abnormality identification value Y may be manually set by a manual setter (first manual setter), or automatically calculated and set on the basis the average value $X_{AVE}$ of the die cushion position signal holding values X, and the plate thickness T by an automatic setter (first automatic setter).

The abnormality identification value Y set by the abnormality identification value setter 335 is not limited to 194.7 mm set as described above, and can be set to a value satisfying the following condition, where the average value of the die cushion position signal holding values X obtained by repeating forming of the single blank material a plurality of number of times is designated by $X_{AVE}$, and the plate thickness of the blank material is designated by T, $$Y\leq(X_{AVE}-0.3T),\text{ and }Y>(X_{AVE}-T) \quad (5).$$

The second comparator 334 that functions as a double blank detecting unit detects, as a double blank, a case where the die cushion position signal holding value X is smaller than the abnormality identification value Y which is set so as to satisfy the above Expression (5).

The reason why the abnormality identification value Y is set by the above Expression (5) is because prior to the die cushion load control start time point, the slide 110 indirectly comes into contact with the cushion pad 128, and pressure (to restore a deviation between a die cushion position command equivalent to a standby position, and a die cushion position) acts on the head-side hydraulic chambers 109 of the oil hydraulic cylinders 130R, 130L being stopped at a die cushion standby position in a position control state, so that a pressure rising time point is advanced. Therefore, the abnormality identification value Y is even small, but is larger than at least ($X_{AVE}$−T), and is smaller than at most ($X_{AVE}$−0.3T) in empirical consideration of robustness of position control (in empirical consideration of pressure rising rate in a case where position control is most robust).

Second Embodiment of Double Blank Detection

The second embodiment is different from the first embodiment in a setting method of the abnormality identification value Y.

The double blank abnormality identification value Y may be determined by actually (experimentally) performing a double blank, and considering the result.

In this example, a die cushion position signal holding value X' at the time of double blank is X'≈194.4 mm, and the abnormality identification value Y may be Y=194.7 mm ($Y=194.4+1\times0.3=194.7$ mm) as a value obtained by adding a change amount (ΔX) of 30% of the plate thickness to X'.

The abnormality identification value Y is determined by adding the change amount (ΔX) to the die cushion position signal holding value X' obtained in a case where a double blank is actually tried. ΔX is mainly influenced by natural vibration of a machine at the moment of indirect contact of the slide 110 with the cushion pad 128 to be changed, and the degree is 10 to 70% of the plate thickness T empirically. Therefore, the abnormality identification value Y set by the abnormality identification value setter 335 can be set to a value satisfying the following condition, from the die cushion position signal holding value X' obtained in a case where double blank materials are tried, and the plate thickness T of the blank material, $$Y>(X'+0.1T),\text{ and }Y\leq(X'+0.7T) \quad (6).$$

The second comparator 334 detects, as a double blank, a case where the die cushion position signal holding value X is smaller than the abnormality identification value Y set by the above Expression (6).

Third Embodiment of Double Blank Detection

A third embodiment of the double blank detection is applied to a case where die cushion load control according to the die cushion device 200 is started with die cushion load change generated in the cushion pad 128 by indirect collision of the slide 110 of the press machine 100 with the cushion pad 128 as a reference.

A die cushion control start time point is recognized by a die cushion load generation reference (time point of recognizing change with rise of pressure generated in the head-side hydraulic chambers 109 of the oil hydraulic cylinders 130R, 130L that generate a die cushion load at the moment of contact of the slide 110 with the cushion pad 128 through the upper die, the material, the blank holder, and the cushion pin), and is being stopped at a standby position in a position control state. In this case, when a double blank is detected, contact is caused at a die cushion position larger than that at a normal time by the single blank material, and pressure starts rising, and therefore the die cushion position signal holding value X becomes larger than the average value $X_{AVE}$.

In this case, the abnormality identification value Y set by the abnormality identification value setter 335 can be set to a value satisfying the following condition, where the average value of the die cushion position signal holding values X is designated by $X_{AVE}$, and the plate thickness of the blank material is designated by T, $$Y\geq(X_{AVE}+0.3T),\text{ and }Y<(X_{AVE}+T) \quad (7)$$

The second comparator 334 detects, as a double blank, a case where the die cushion position signal holding value X is larger than the abnormality identification value Y which is set by the above Expression (7).

The reason why the abnormality identification value Y is set by the above Expression (7) is because the pressure rising degree is influenced by natural vibration of a machine in accordance with the robustness of position control, and variation is generated every cycle. Therefore, the abnormality identification value Y is smaller than at most ($X_{AVE}$+T), and is at least ($X_{AVE}$+0.3T) or more in empirical consideration of variation of pressure change.

Fourth Embodiment of Double Blank Detection

A fourth embodiment is different from the third embodiment in a setting method of the abnormality identification value Y.

The double blank abnormality identification value Y may be determined by actually (experimentally) performing a double blank, and considering the result.

In this example, the die cushion position signal holding value X' at the time of double blank is X'≈194.4 mm, and the abnormality identification value may be Y=194.1 mm (Y=194.4−1×0.3=194.1 mm) as a value obtained by adding a change amount (ΔX) of 30% of the plate thickness from X'.

The abnormality identification value Y is determined by subtracting a change amount (ΔX) from a die cushion position signal holding value X' obtained in a case where a double blank is actually tried. ΔX is mainly influenced by natural vibration of a machine at the moment of indirect contact of the slide 110 with the cushion pad 128 to be changed, and the degree is 10 to 70% of the plate thickness T empirically. Therefore, the abnormality identification value Y set by the abnormality identification value setter 335 can be set to a value satisfying the following condition, from the die cushion position signal holding value X' obtained in a case where double blank materials are tried, and the plate thickness T of the blank material, $$Y \leq (X' - 0.1T), \text{ and } Y \geq (X' - 0.7T) \quad (8).$$

The second comparator 334 detects, as a double blank, a case where the die cushion position signal holding value X is larger than the abnormality identification value Y set by the above Expression (8).

[Safety Processing Device]

The safety processing device 305 illustrated in FIG. 6 outputs a command for quickly braking the slide 110 to the press controller 190 when a double blank is detected by the double blank detecting device 302.

Upon receipt of this command, the press controller 190 outputs the torque command signal 197 in the direction opposite to the slide operation direction to the press driving device 240, and starts quick braking of the slide 110. Additionally, after the slide 110 is stopped (at the almost the same time as the stopping), the press controller 190 turns off the solenoid valve 235 for brake release of the braking device 230, and actuates braking.

When the double blank detecting device 302 detects a double blank, the safety processing device 305 outputs the command for quickly braking the slide 110, and a command for depressurizing the head-side hydraulic chambers 109 of the oil hydraulic cylinders 107R, 107L incorporated in the slide 110, to the overload removal device 220 through a selector 198 at the same time.

Upon receipt of this command, the overload removal device 220 turns on the solenoid (depressurizing) valve 228, the head-side hydraulic chambers 109 of the oil hydraulic cylinders 107R, 107L are connected to the low pressure accumulator 223 through the solenoid (depressurizing) valve 228, and the head-side hydraulic chambers 109 are depressurized.

Furthermore, when the double blank detecting device 302 detects a double blank, the safety processing device 305 outputs a command for causing maximum capacity of 3,000 kN to act on the cushion pad 128 to the pressure controller 134 in order to quickly contract the depressurize head-side hydraulic chambers 109 of the oil hydraulic cylinders 107R, 107L.

Upon receipt of this command, the pressure controller 134 outputs the torque command signal 177L, 177R for causing maximum capacity of 3,000 kN to act on the cushion pad 128.

[Comparative Example of Double Blank Detection]

Figure 9:
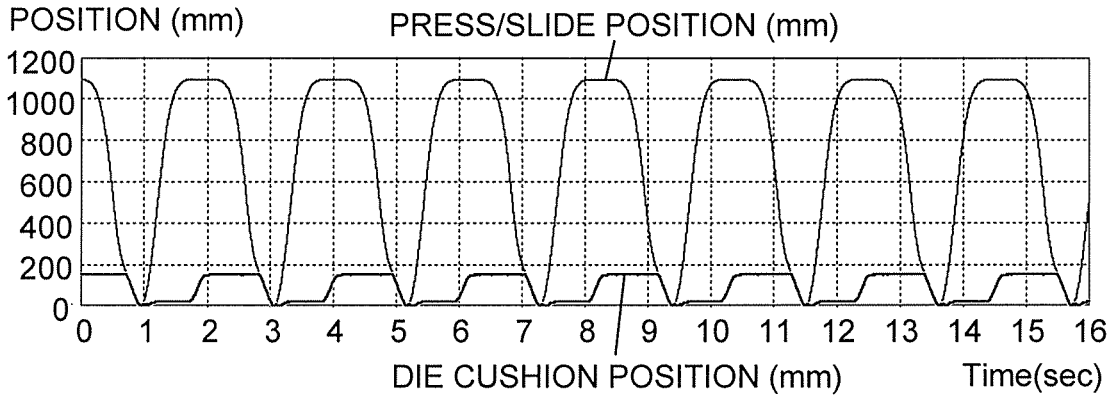
FIG. 9 is a waveform chart illustrating a press machine-slide position, and a die cushion position.
Figure 10:
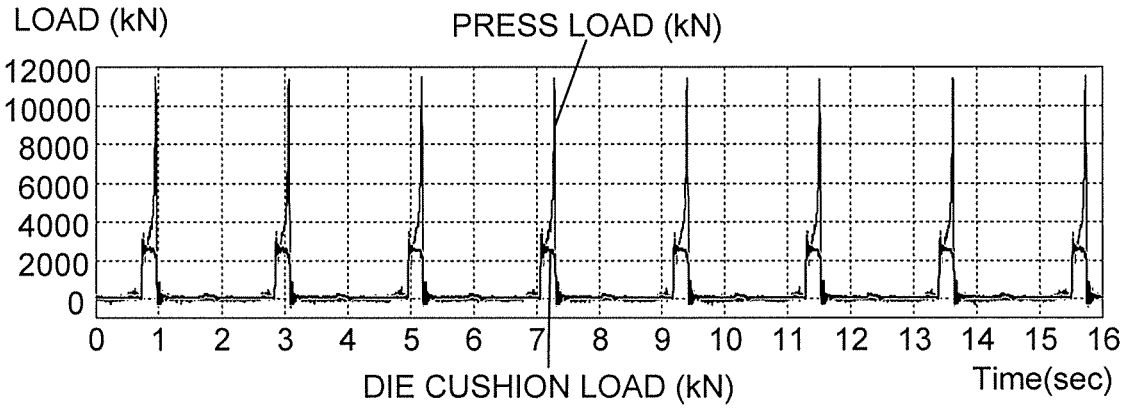
FIG. 10 is a waveform chart illustrating a press load, and a die cushion load.

FIG. 9 is a waveform chart illustrating a press machine-slide position, and a die cushion position with a lapse of time, and FIG. 10 is a waveform chart illustrating a press load, and a die cushion load, in a case where a thin plate having a thickness of 1 mm, and a sectional shape of about 2,000 mm×1,000 mm is normally continuously (drawn) formed by using a press machine having maximum pressurizing capacity of 20,000 kN.

In each of FIG. 9 and FIG. 10, waveforms of 8 cycles are illustrated, and waveforms (both positions, load) in the same form are repeatedly act between the cycles, at a glance.

FIG. 11 to FIG. 14 illustrate a die cushion position signal holding value at a rising time point of die cushion load signal 500 kN, a die cushion position signal holding value at a rising time point of press load signal 1,000 kN, a press/slide position signal holding value at a rising time point of die cushion load signal 500 kN, and a press/slide position signal holding value at a rising time point of press load signal 1,000 kN, respectively. These position signal holding values are obtained by performing a calculating process of data illustrated in FIG. 9 and FIG. 10.

Figure 11:
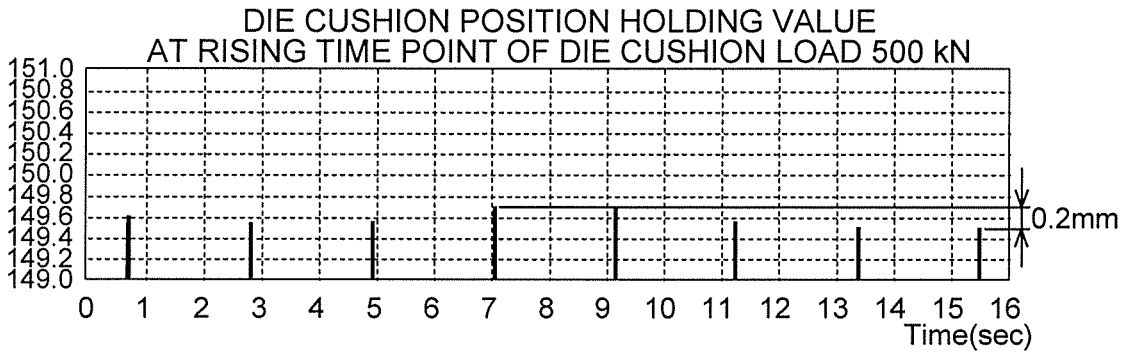
FIG. 11 is a diagram illustrating change between cycles of a die cushion position signal holding value at a rising time point of die cushion load signal 500 kN.
Figure 12:
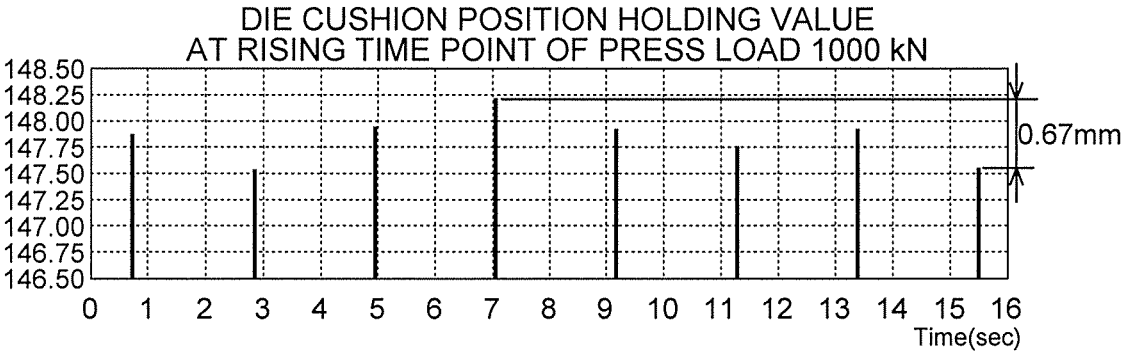
FIG. 12 is a diagram illustrating change between cycles of a die cushion position signal holding value at a rising time point of press load signal 1000 kN.
Figure 13:
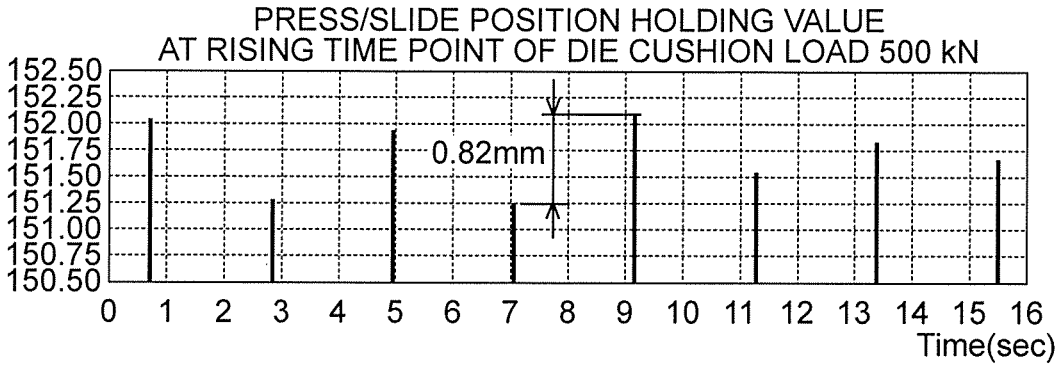
FIG. 13 is a diagram illustrating change between cycles of a press/slide position signal holding value at a rising time point of die cushion load signal 500 kN.
Figure 14:
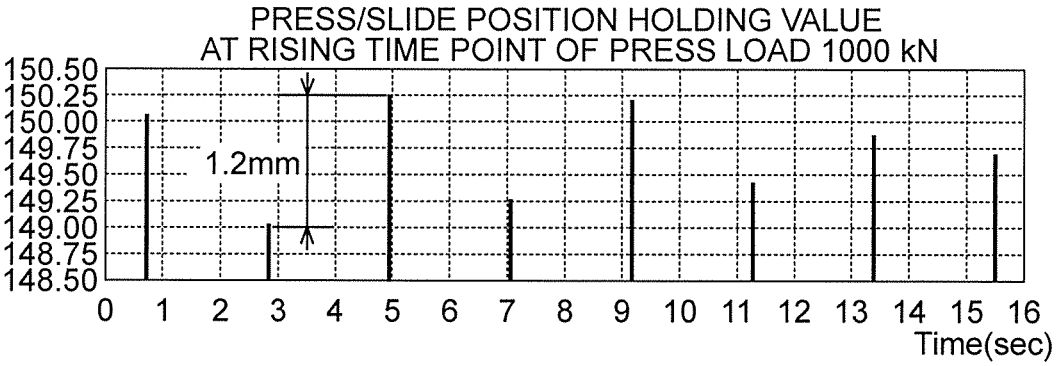
FIG. 14 is a diagram illustrating change between cycles of a press/slide position signal holding value at a rising time point of press load signal 1000 kN.

Change between the cycles in the position signal holding value illustrated in FIG. 11 is the smallest, and the change between the cycles becomes larger in the order of the position holding values illustrated in FIG. 12, FIG. 13 and FIG. 14.

The reason why the rise of the press load signal is 1,000 kN (twice the die cushion load) is because change at 500 kN identical with a die cushion load signal is large (due to resolution), and the position holding value largely changes.

As illustrated in FIG. 14, in a case where the press load signal and the slide position holding value are used (a case of a double blank detection method described in PTL 1), the change of the position signal holding value is the largest.

It is considered that this reason is because (lowering of resolution in load detection, or a position detection value with) a heavy, thick, long and large press machine relative to the die cushion device attached thereto, or a difference between both load generation mechanisms caused by secondarily generating a press load in accordance with a forming load or state change (such as linear expansion of a column) of a press machine (without control), and controlling the die cushion load (in the servo die cushion device) to a constant value, a difference of responsiveness and accuracy between the both, resulting from output of a press load signal from a press load detector dedicated for monitoring, and output of a die cushion load signal from a die cushion load detector dedicated for die cushion load control.

The press load signal and the die cushion load signal rise at a time point when the material (and an indirect member such as a die) is sandwiched, a press/slide position and a die cushion position coincide with each other. In a state where the thickness of the material is constant, when repeating action of a load signal and a position signal are stable every cycle, the position signal takes a substantially constant value every load value, and a position signal holding value at a time point of rising to be a constant load signal is stable at a normal time. In a case where the thickness of the material is changed by a double blank, for example, in a case where a thin plate having a plate thickness of about 1 mm is formed, at the time of an abnormality of changing the thickness of the material to about 2 mm, it is important that stability of the position signal holding value at a normal time, namely, a change range is small, in order to reliably detect a double blank from the change of the position signal holding value.

In a double blank detection method of PTL 1 using the press load signal and the press/slide position signal illustrated in FIG. 14, double blank detection is impossible, since the change range of the position signal holding value becomes 1.2 mm larger than the thin plate thickness (1 mm).

One the other hand, in a double blank detection method of the present invention using the die cushion load signal and the die cushion position signal, the change range of the position signal holding value becomes 0.2 mm sufficiently smaller than the thin plate thickness (FIG. 11), and therefore it is possible to accurately detect a double blank.

[Action of Double Blank Detection and Safety Processing Device]

Figure 15:
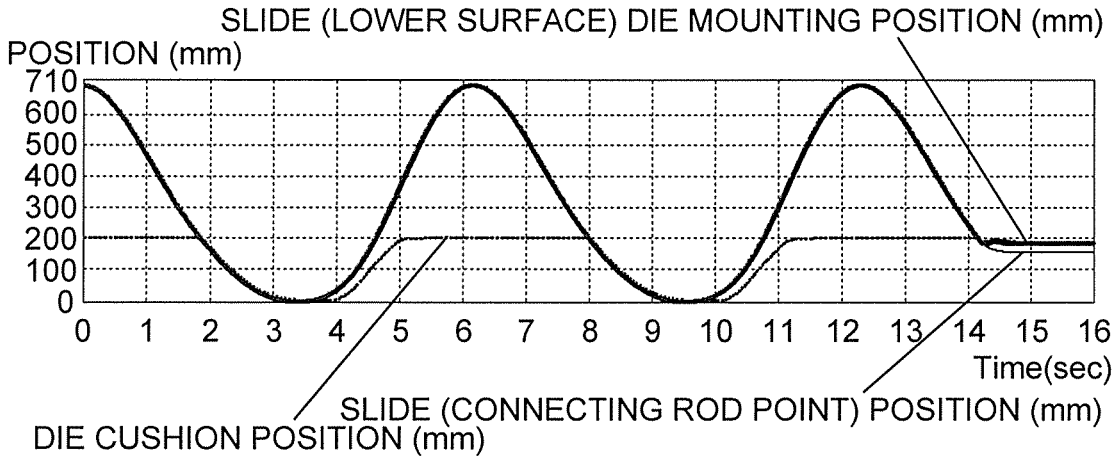
FIG. 15 is a waveform chart illustrating a slide position and a die cushion position.
Figure 16:
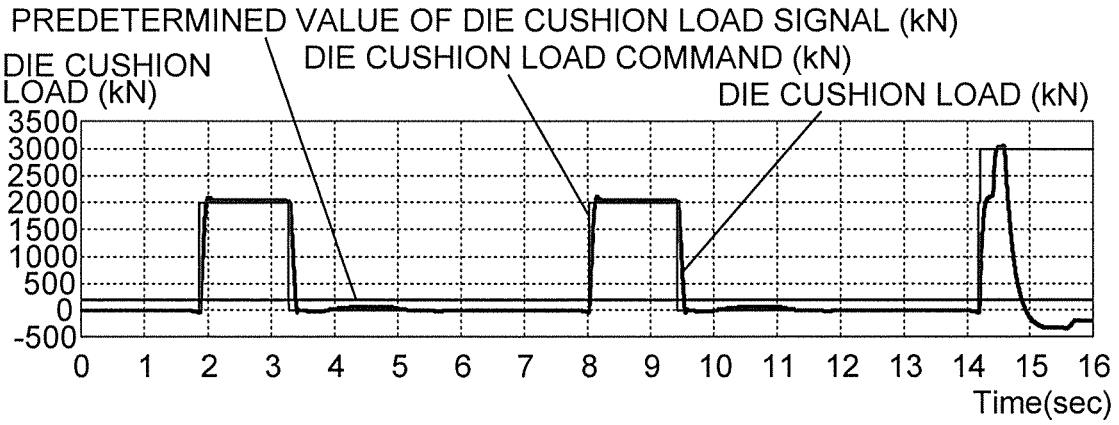
FIG. 16 is a waveform chart illustrating a predetermined value of a die cushion load signal, a die cushion load command, and a die cushion load.

FIG. 15 is a waveform chart illustrating a slide position and a die cushion position, and FIG. 16 is a waveform chart illustrating a predetermined value of a die cushion load signal, a die cushion load command, and a die cushion load.

Figure 17:
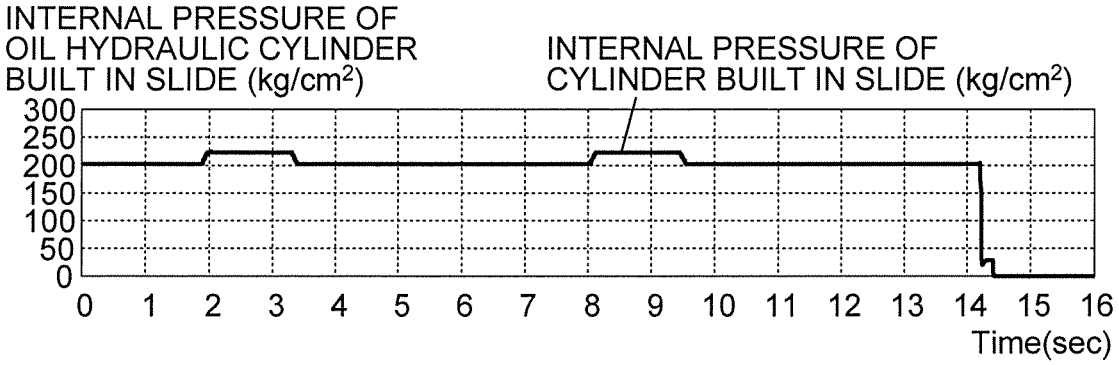
FIG. 17 is a waveform chart illustrating pressure of a head-side hydraulic chamber of oil hydraulic cylinders 107R, 107L with built-in slides.
Figure 18:
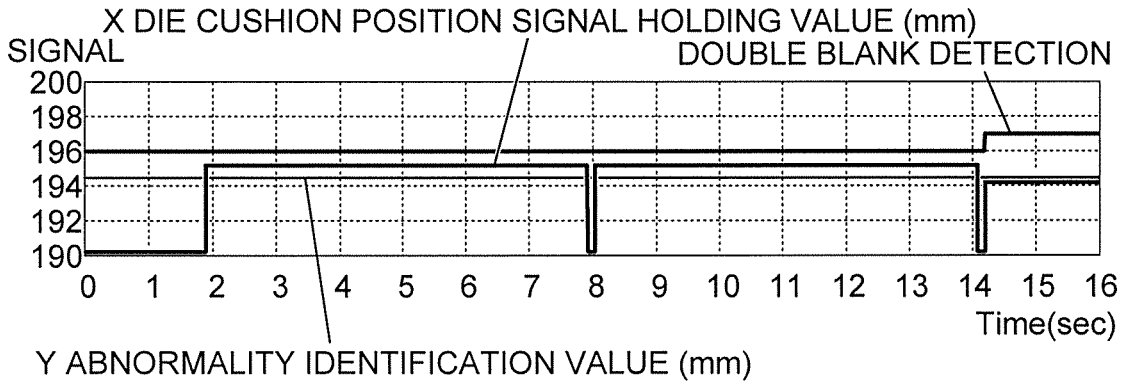
FIG. 18 is a waveform chart illustrating a die cushion position signal holding value X, an abnormality identification value Y, and detection of a double blank.

FIG. 17 illustrates the pressure of the head-side hydraulic chamber of the oil hydraulic cylinders 107R, 107L with built-in slides, and FIG. 18 is a waveform chart illustrating a die cushion position signal holding value X, an abnormality identification value Y, and detection of a double blank.

In each of FIG. 15 to FIG. 18, waveforms of 3 cycles are illustrated, and a first cycle, and a second cycle are normally function. During a die cushion load control step, the die cushion load is maintained at about 2,050 kN which tends to be slightly excessive at the time of start of die cushion load control in contrast to a command of 2,000 kN (FIG. 16).

The pressure of the head-side hydraulic chamber of each of the oil hydraulic cylinders 107R, 107L increases in accordance with a press load value at the time of forming (die cushion load action) with respect to initial pressure of 200 kg/cm$^2$ (FIG. 17).

The die cushion position signal holding value X shifts from 195.23 mm to 195.13 mm (FIG. 18). These are held at the die cushion load control start time point, and the press/slide position is not held at a position of 210 mm by 10 mm above a next die cushion load control start slide position of 200 mm.

In the third cycle, a double blank is detected. The die cushion position signal holding value X is 194.4 mm, and smaller than the double blank abnormality identification value Y (=194.7 mm), and therefore the double blank is detected by the double blank detecting device 302 (FIG. 18).

Just before double blank detection, a time point when the blank holders 124 and the upper die 120 come into contact with each other through blank materials (two sheets) (time point just before die cushion load control start) is the state of the right half of the press machine illustrated in FIG. 2. In this state, a distance between the blank material lower surface and the lower die 122 (punch) is 15 mm, and when the slide 110 (lower surface) further does not lower by 15 mm, forming is not started.

FIG. 19 to FIG. 22 each illustrate a cycle waveform of partially enlarged part of FIG. 15 to FIG. 18, mainly at the time of double blank detection.

Figure 19:
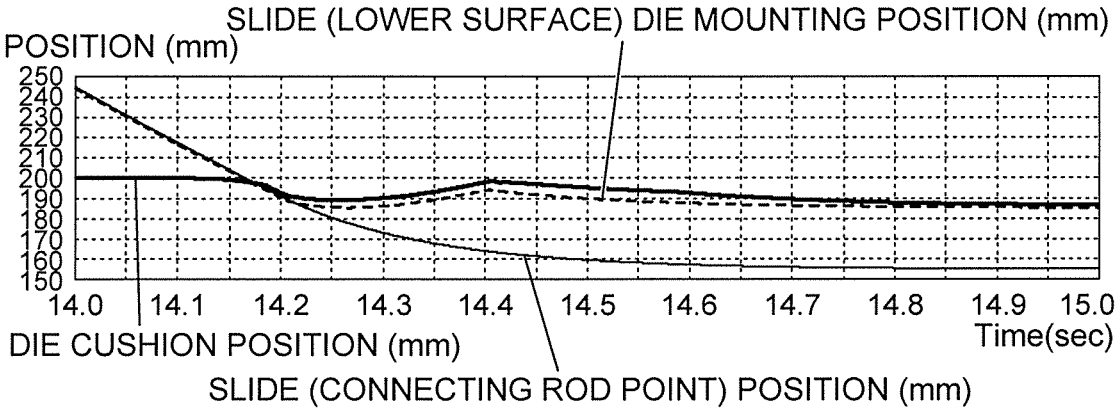
FIG. 19 is a partially enlarged waveform chart of the waveform chart illustrated in FIG. 15 particularly at the time of double blank detection.

When the double blank detecting device 302 detects a double blank, the safety processing device 305 gives a command to the press controller 190 in order to quickly brake the slide 110. Upon receipt of this command, a slide (connecting rod point) position depending on the crank shaft angle reaches an emergency stop (FIG. 19).

However, the slide (connecting rod point) position lowers by about 40 mm by inertia due to inertia of an entire movable unit interlocked with the slide 110, and stops at 155 mm.

Figure 21:
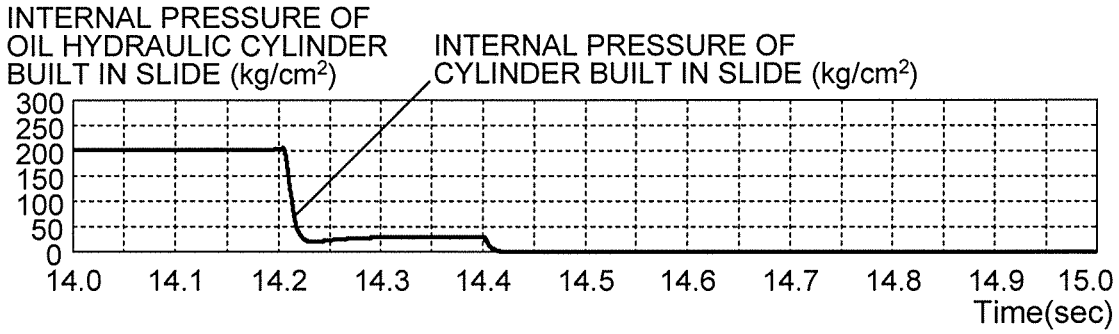
FIG. 21 is a partially enlarged waveform chart of the waveform chart illustrated in FIG. 17 particularly at the time of double blank detection.
Figure 22:
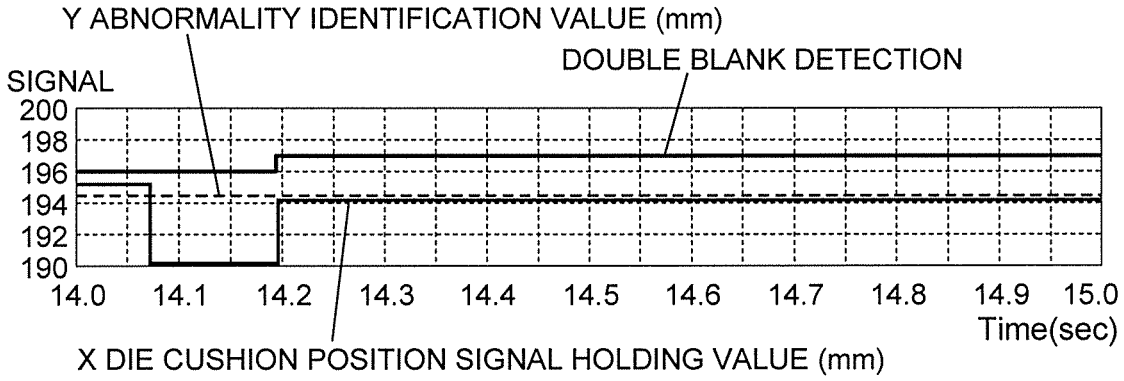
FIG. 22 is a partially enlarged waveform chart of the waveform chart illustrated in FIG. 18 particularly at the time of double blank detection.

At the same time, the safety processing device 305 gives a command to the solenoid (depressurizing) valve 228 through the selector 198 in order to depressurize the head-side hydraulic chambers of the oil hydraulic cylinders 107R, 107L with built-in slides. Upon receipt of this command, the head-side hydraulic chambers are quickly depressurized (FIG. 21). In order to enhance quick depressurizing action, the solenoid valve 228 having large valve opening (flow coefficient), and enabling fast response is selected. Furthermore, in order to enhance response, an applied voltage at an ON (excitation) starting time point is instantaneously increased (improved in order to advance a phase of a substantially primary delay characteristic with solenoid force action of a solenoid valve).

At the same time, the safety processing device 305 gives a die cushion load command to the pressure controller 134, so as to cause maximum capacity of 3,000 kN to act in order to quickly contract the depressurized head-side hydraulic chambers. Upon receipt of this command, the die cushion load command immediately changes to 3,000 kN (a broken line of FIG. 20). The pressure of each of the head-side hydraulic chambers of the oil hydraulic cylinders with built-in slides lowers to about 20 kg/cm$^2$ at a time point when the slide (connecting rod point) position reaches about 185 mm after about 30 ms (vicinity of 14.225 s of FIG. 21).

Figure 20:
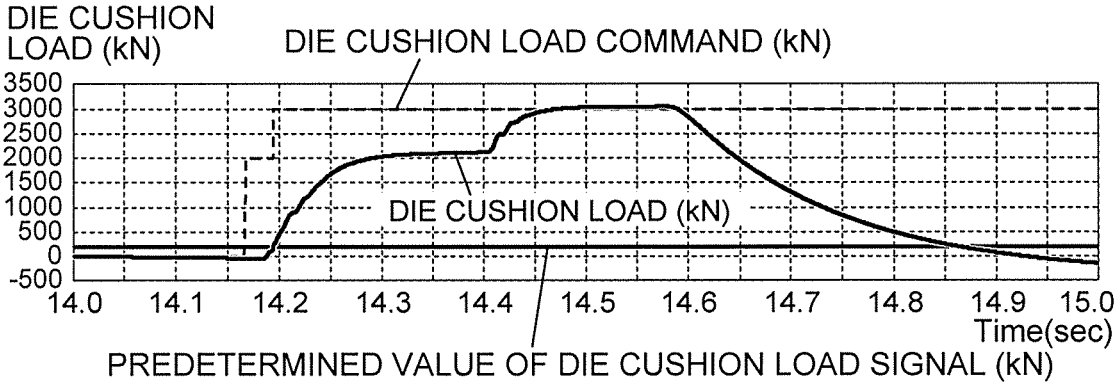
FIG. 20 is a partially enlarged waveform chart of the waveform chart illustrated in FIG. 16 particularly at the time of double blank detection.

After this, the oil hydraulic cylinders 107R, 107L start contracting, and a slide (lower surface) die mounting position interlocked with the above also reverses (turns to rise) (broken line of FIG. 19). At this time, the die cushion load is influenced by lowering of the speed of the slide lower surface that presses the die cushion, and is fixed to about 2,000 kN smaller than a command of 3,000 kN once (FIG. 20). At this time, the oil hydraulic cylinders 107R, 107L are indirectly pressed from below by a die cushion load, and continue to contract while discharging hydraulic oil.

About 25 kg/cm$^2$ which is a pressure loss generated when a discharging oil amount flows in the solenoid valve 228 acts on the head-side hydraulic chambers of the oil hydraulic cylinders 107R, 107L. In the vicinity of 14.3 to 14.4 s illustrated in FIG. 21, the oil hydraulic cylinders 107R, 107L each reach a contract (machine) limit, and the discharging oil amount is drawn up, and the pressure of each head-side hydraulic chamber lowers to almost 0. Additionally, the speed of the slide lower surface is equal to a predetermined sliding speed, and therefore the die cushion load changes to 3,000 kN as commanded (FIG. 20). At this stage, the slide (connecting rod point position) still slightly continues lowering operation (FIG. 19), and the die cushion terminates load control (FIG. 20).

In this series of operation, a minimum position of the slide (lower surface) die mounting position is about 185 mm (the vicinity of 14.26 s, and the vicinity of 15 s of FIG. 19), and is equivalent to a left half state of the press machine illustrated in FIG. 2. The left half state of the press machine illustrated in FIG. 2 illustrates a state just before a blank material comes into contact with the lower die 122 (punch), and forming is started. When the double blank is detected by this die protection function, a machine is safely stopped previously (before forming).

Thus, as long as the position of the slide lower surface in consideration of the influence of contraction of the oil hydraulic cylinders 107R, 107L exists in a region where forming is not started, the oil hydraulic cylinders 107R, 107L are quickly contracted, and a maximum die cushion load acts until the contraction is completed. In a forming region at the time of double blank detection being a double blank material state extremely dangerous for a die, a die cushion load basically does not act.

In the forming region, in other case, for example, in a case where a light beam type safety device is shielded, at the time of press machine emergency stop with operation, a cope is different from a cope in a situation where the predetermined die cushion load acts in order to suppress damage of the die due to generation of drawing wrinkle until the press/slide is stopped.

[Others]

The die protecting device 300 including the double blank detecting device 302 and the safety processing device 305 is configured to be incorporated in the die cushion controller 170 in this embodiment, but the present invention is not limited to this, and the die protecting device 300 may be provided outside the die cushion controller 170.

The present invention may include only the double blank detecting device. In this case, as the safety processing device at the time of double blank detection, a device other than the safety processing device of this embodiment may be applied. It goes without saying that the double blank detecting device according to the present invention can also detect a state where three or more blank materials are overlapped.

Additionally, it is preferable that a carrier device that sets the blank materials in the press machine 100 immediately stop, when the double blank detecting device 302 detects a double blank.

Furthermore, the cushion pad is supported by the two oil hydraulic cylinder in this embodiment, but the number of the oil hydraulic cylinders is not limited to two, and may be one, or more than two. Additionally, the die cushion driving unit is not limited to a unit that uses oil hydraulic cylinders, and any unit that supports a cushion pad, elevates and lowers the cushion pad, and generates a desired die cushion load in the cushion pad may be employed.

The oil hydraulic cylinder with a built-in slide uses oil as hydraulic fluid, but is not limited to this. It goes without saying that a hydraulic cylinder that uses water or other liquid can be used in the present invention.

Furthermore, it goes without saying that the present invention is not limited to the above embodiments, and various improvements and modifications may be performed without departing the scope of the present invention.

What is claimed is:

1. A double blank detecting device for a press machine, the double blank detecting device comprising:

a position signal acquiring unit that acquires a die cushion position signal indicating a position of a cushion pad of a die cushion device attached to the press machine;

a load signal acquiring unit that acquires a die cushion load signal indicating a die cushion load generated in the cushion pad of the die cushion device; and a double blank detecting unit that detects, as a double blank, a state where a plurality of blank materials supplied to the press machine are overlapped, based on the die cushion position signal acquired by the position signal acquiring unit, and the die cushion load signal acquired by the load signal acquiring unit, wherein the double blank detecting unit holds a die cushion position signal at a time point when the die cushion load signal rises to a predetermined value, compares a holding value of the held die cushion position signal with an abnormality identification value, and detects the double blank.

2. The double blank detecting device for a press machine according to claim 1, wherein in a case where die cushion load control by the die cushion device is started with a position of a slide of the press machine at a time of indirect collision of the slide with a single blank material as a reference, where the abnormality identification value is designated by Y, an average value of the die cushion position signal holding values obtained by repeatedly forming the single blank material a plurality of number of times is designated by $X_{AVE}$, and a plate thickness of the blank material is designated by T, the abnormality identification value Y is set to a value satisfying a condition as follows:

$$Y \leq (X_{AVE} - 0.3T), \text{ and } Y > (X_{AVE} - T), \text{ and}$$

the double blank detecting unit detects, as the double blank, a state where the holding value of the held die cushion position signal is smaller than the abnormality identification value Y.

3. The double blank detecting device for a press machine according to claim 1, wherein in a case where die cushion control by the die cushion device is started with a position of a slide of the press machine at a time of indirect collision of the slide with a single blank material as a reference, where the abnormality identification value is designated by Y, a die cushion position signal holding value obtained in a case where double blank materials are tried is designated by X', and a plate thickness of the blank material is designated by T, the abnormality identification value Y is set to a value satisfying a condition as follows:

$$Y \geq (X' + 0.1T), \text{ and } Y \leq (X' + 0.7T), \text{ and}$$

the double blank detecting unit detects, as the double blank, a state where the holding value of the held die cushion position signal is smaller than the abnormality identification value Y.

4. The double blank detecting device for a press machine according to claim 1, wherein in a case where die cushion load control by the die cushion device is started with die cushion load change generated in the cushion pad due to indirect collision of a slide of the press machine with the cushion pad as a reference, where the abnormality identification value is designated by Y, an average value of the die cushion position signal holding values obtained by repeatedly forming a single blank material a plurality of number of times is designated by $X_{AVE}$, and a plate thickness of the blank material is designated by T, the abnormality identification value Y is set to a value satisfying a condition as follows:

$$Y \geq (X_{AVE} + 0.3T), \text{ and } Y < (X_{AVE} + T), \text{ and}$$

the double blank detecting unit detects, as the double blank, a state where the holding value of the held die cushion position signal is larger than the abnormality identification value Y.

5. The double blank detecting device for a press machine according to claim 1, wherein in a case where die cushion load control by the die cushion device is started with die cushion load change generated in the cushion pad due to indirect collision of a slide of the press machine with the cushion pad as a reference, where the abnormality identification value is designated by Y, a die cushion position signal holding value obtained in a case where double blank materials are tried is designated by X', and a plate thickness of the blank material is designated by T, the abnormality identification value Y is set to a value satisfying a condition as follows:

$Y \leq (X' - 0.1T)$, and $Y \geq (X' - 0.7T)$, and the double blank detecting unit detects, as the double blank, a state where the holding value of the held die cushion position signal is larger than the abnormality identification value Y.

6. The double blank detecting device for a press machine according to claim 2, further comprising a first manual setter that manually sets the abnormality identification value, or a first automatic setter that automatically calculates and sets the abnormality identification value.

7. The double blank detecting device for a press machine according to claim 2, wherein a predetermined value of the die cushion load signal is a value within a range of not less than 5% and not more than 20% of a maximum die cushion load of the die cushion device.

8. The double blank detecting device for a press machine according to claim 7, further comprising a second manual setter that manually sets a predetermined value of the die cushion load signal, or a second automatic setter that automatically calculates and sets the predetermined value of the die cushion load signal based on the maximum die cushion load of the die cushion device.

9. The double blank detecting device for a press machine according to claim 1, wherein the die cushion position signal is outputted from a die cushion position detector of the die cushion device, the die cushion load signal is outputted from a die cushion load detector of the die cushion device, the position signal acquiring unit acquires the die cushion position signal from the die cushion position detector, and the load signal acquiring unit acquires the die cushion load signal from the die cushion load detector.

10. A die protecting device for a press machine comprising:

the press machine having a braking device that brakes a slide driven by a press driving device of the press machine, and a hydraulic cylinder that is incorporated in the slide, and moves a die mounting surface of the slide relative to movement of the slide driven by the press driving device;

a double blank detecting device comprising a position signal acquiring unit that acquires a die cushion position signal indicating a position of a cushion pad of a die cushion device attached to the press machine, a load signal acquiring unit that acquires a die cushion load signal indicating a die cushion load generated in the cushion pad of the die cushion device, and a double blank detecting unit that detects, as a double blank, a state where a plurality of blank materials supplied to the press machine are overlapped, based on the die cushion position signal acquired by the position signal acquiring unit and the die cushion load signal acquired by the load signal acquiring unit, wherein the double blank detecting unit holds a die cushion position signal at a time point when the die cushion load signal rises to a predetermined value, compares a holding value of the held die cushion position signal with an abnormality identification value, and detects the double blank; and a safety processing device that causes the braking device to start quick braking of the slide, and depressurizes the hydraulic cylinder to relatively move one portion including the die mounting surface of the slide in an elevating direction, when the double blank detecting unit detects the double blank.

11. The die protecting device for a press machine according to claim 10, wherein the die cushion device includes:

a die cushion driving unit that supports the cushion pad, elevates and lowers the cushion pad, and generates a die cushion load in the cushion pad;

a die cushion load command device that outputs a die cushion load command; and a die cushion load controller that controls the die cushion driving unit based on the die cushion load command output from the die cushion load command device, and generates a die cushion load corresponding to the die cushion load command in the cushion pad, wherein the die cushion load command device outputs a predetermined die cushion load command, causes the hydraulic cylinder to contract by a die cushion load generated in the cushion pad in response to the die cushion load command, and to relatively move one portion including a die mounting surface of the slide in an elevating direction, in a period when the slide reaches a stop, only in a region where forming is not started among a region where the cushion pad moves, when the double blank detecting unit detects the double blank.

12. The die protecting device for a press machine according to claim 11, wherein the die cushion device includes:

a die cushion position command device that outputs a die cushion position command; and a die cushion position controller that controls the die cushion driving unit based on the die cushion position command output from the die cushion position command device after termination of die cushion load control by the die cushion load controller, and raises the cushion pad to move the cushion pad to a predetermined die cushion standby position, wherein the predetermined die cushion standby position is a position obtained by movement in the elevating direction from a forming start position by a predetermined amount.

13. The die protecting device for a press machine according to claim 12, wherein the region where the forming is not started is a region between the predetermined die cushion standby position, and a position at which the forming is started.

14. The die protecting device for a press machine according to claim 11, wherein when the double blank detecting unit detects the double blank, the die cushion load command device automatically outputs a maximum die cushion load command as the predetermined die cushion load command.

* * * * *